US007497407B2

(12) United States Patent
Blankenship et al.

(10) Patent No.: US 7,497,407 B2
(45) Date of Patent: Mar. 3, 2009

(54) TRANSFORMABLE INTRAVENOUS POLE

(75) Inventors: Peter B Blankenship, Anoka, MN (US); Samuel A. Blankenship, Anoka, MN (US); Brent G. Norman, Anoka, MN (US)

(73) Assignee: Streamline, Inc., Minneapolis, MN (US)

( * ) Notice: Subject to any disclaimer, the term of this patent is extended or adjusted under 35 U.S.C. 154(b) by 0 days.

(21) Appl. No.: 11/711,478

(22) Filed: Feb. 27, 2007

(65) Prior Publication Data

US 2007/0267550 A1 Nov. 22, 2007

Related U.S. Application Data

(60) Provisional application No. 60/777,467, filed on Feb. 27, 2006.

(51) Int. Cl.
*A47K 1/04* (2006.01)

(52) U.S. Cl. ..... 248/129; 248/170

(58) Field of Classification Search ..... 248/129, 248/132, 135, 136, 98, 150, 168, 170, 311.3; 280/43.24, 43.17, 43.2; 5/503.1, 658
See application file for complete search history.

(56) References Cited

U.S. PATENT DOCUMENTS

| | | | | | |
|---|---|---|---|---|---|
| 4,572,536 | A * | 2/1986 | Doughty | ..... | 280/304.1 |
| 4,744,536 | A * | 5/1988 | Bancalari | ..... | 248/125.8 |
| 4,892,279 | A * | 1/1990 | Lafferty et al. | ..... | 248/125.8 |
| 5,374,074 | A * | 12/1994 | Smith | ..... | 280/304.1 |
| 5,421,548 | A * | 6/1995 | Bennett et al. | ..... | 248/129 |
| 2004/0222341 | A1 | 11/2004 | Breda et al. | ..... | 248/200 |
| 2006/0243500 | A1 | 11/2006 | Wiff et al. | ..... | 180/16 |

OTHER PUBLICATIONS

"Nurses Lifting Injuries Research Shows Good Body Mechanics Are Not Enough", Nevada Nurses Association, (May-Jul. 2003). Provided by ProQuest Information and Learning Company.
"American Nurses Association Launches 'Handle with care' Ergonomics Campaign", Nevada Nurses Association (Nov. 2003). Provided by ProQuest Information and Learning Company.
"Emerging Issue: Keeping Patients and Nurses Safe", New Jersey State Nurse's Association (Jan./Feb. 2005). Provided by ProQuest Information and Learning Company.
"Nurses and Preventable Back Injuries", American Association of Critical-Care Nurses, (2003).

* cited by examiner

*Primary Examiner*—A. Joseph Wujciak, III
(74) *Attorney, Agent, or Firm*—Vidas, Arrett & Steinkraus

(57) ABSTRACT

A patient transporting device having a mobile IV pole which comprises a wheeled base with an enclosure that substantially covers the wheels and a bumper secured to the enclosure. A pole is coupled to the base, and a plurality of hook or other holders are provided for holding intravenous fluid reservoirs. The pole may include first and second arms that extend substantially vertically upwardly from the base, each arm made up of respective lower, central, and upper telescoping tubular portions. The lower portions of the arms are securely coupled to the base, the upper portions are rigidly interconnected with one another, and the central portions of the first and second arms are rigidly interconnected by a stabilization bar which has a plurality of routing channels therein for routing flexible tubing. An obliquely oriented handle is coupled to the pole and is axially movable along at least a portion of the pole. The IV pole may be provided with an electrical receptacle having a retractable power cord. A hook or other hanger also may be provided at a lower portion of the pole for hanging a catheter bag, and a further hook, eyelet, or other coupling may be provided for towing the IV pole along with a gurney, wheelchair, or bed, for example.

14 Claims, 22 Drawing Sheets

TRANSFORMABLE INTRAVENOUS POLE

CROSS-REFERENCE TO RELATED APPLICATIONS

This application claims priority from Provisional Application 60/777,467 filed Feb. 27, 2006.

STATEMENT REGARDING FEDERALLY SPONSORED RESEARCH

Not Applicable

BACKGROUND OF THE INVENTION

1. Field of the Invention

In some embodiments this invention relates to an improved patient transportation device, its manufacture, and methods of use. More particularly some embodiments relate to intravenous poles with transformable base widths to better facilitate the transport of patients.

2. Description of the Related Art

For many years, patients needing intravenous fluid transfusions have been able to be moved by a patient transportation device such as a wheelchair, wheeled bed, stretcher, gurney, or the like while receiving such transfusions by the use of mobile IV poles. These IV poles, however, suffer from a number of drawbacks.

One unsatisfactory form of a mobile IV pole is a pole permanently attached to, and rising out of, the patient transportation device such as that described in published US Patent Application 2006/0243500A1. This form imposes significant burdens on hospital staff as each time the patient is moved, pumps and fluid bags must both be transferred onto the transportation device before the patient is moved, and then again the pumps and fluid bags must be transferred off of the transportation device once the patient arrives at their destination. The repeated transferal of bags and pumps increases the risks of bags or pumps being dropped leading to wasted medicines needing replacement and wasted environmental services cleaning up spills as well as damage occurring to expensive pumps and equipment. Similarly the permanently attached pole makes the transportation device bulky causing awkward and difficult movement, storage, and maintenance. In the case of beds, permanently attached poles render the beds particularly bulky, and difficult to maneuver. Other problems relate to difficulty in linen changes. Further, beds with poles significantly increase the difficulty of patient transfer into and out of the bed. Most seriously of all, constant removal and re-attachment of IV bags and pumps increases the risks of IV leads being strained or pulled entirely from the patient's body, complicating a patient's treatment and potentially putting the individual at risk of infection or improper treatment.

Another unsatisfactory form of mobile IV pole is a free standing wheeled pole that is moved alongside the patient transfer apparatus such as that described in published US Patent Application 2006/0222341A1. This device unfortunately also imposes significant burdens on hospital staff. In this device one hand must be used to push the patient transfer apparatus and another to simultaneously move the IV pole. Because patient transfer apparatuses may be heavy, and not designed for one handed pushing, repeatedly utilizing one person to simultaneously move both the pole and the transfer apparatus causes significant strain, which often results in back and sprain injuries in medical personnel. Also, such pushing increases the risk of injury to a patient in that the pole may tip over onto the patient or that the patient transfer apparatus may strike walls or objects and aggravate an injury. The alternative of utilizing multiple medical personnel to transport a single patient is inefficient and cost prohibitive in an era of scarce nurses and other medical personnel.

For at least these reasons there is a need for an improved patient transport device. The art referred to and/or described above is not intended to constitute an admission that any patent, publication or other information referred to herein is "prior art" with respect to this invention. In addition, this section should not be construed to mean that a search has been made or that no other pertinent information as defined in 37 C.F.R. §1.56(a) exists.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

BRIEF SUMMARY OF THE INVENTION

At least one embodiment of the invention is directed to a patient transport device comprising a patient holding apparatus and a wheeled IV pole. The wheels of the wheeled IV pole are adjustable allowing the wheels to be disposed adjacent to each other or moved farther apart. When moved farther apart, the wheeled IV pole is stable and more resistant to falling over. When the wheels are moved closer together, the patient transport device can be more easily moved by a single person. At least one embodiment of the inventive concept is directed to a transport device in which the holding apparatus is one device selected from the list consisting of: a wheelchair, a bed, a wheeled bed, a stretcher, a gurney, and any combination thereof. At least one embodiment of the inventive concept is directed to a transport device in which the holding apparatus further comprises a clamp capable of removably attaching the wheeled IV pole to the patient holding apparatus. This and other aspects of the invention are described in more detail in the accompanying description and drawings.

BRIEF DESCRIPTION OF THE SEVERAL VIEWS OF THE DRAWINGS

The invention is best understood from the following detailed description when read in connection with accompanying drawings, in which.

DETAILED DESCRIPTION

Figure 1:
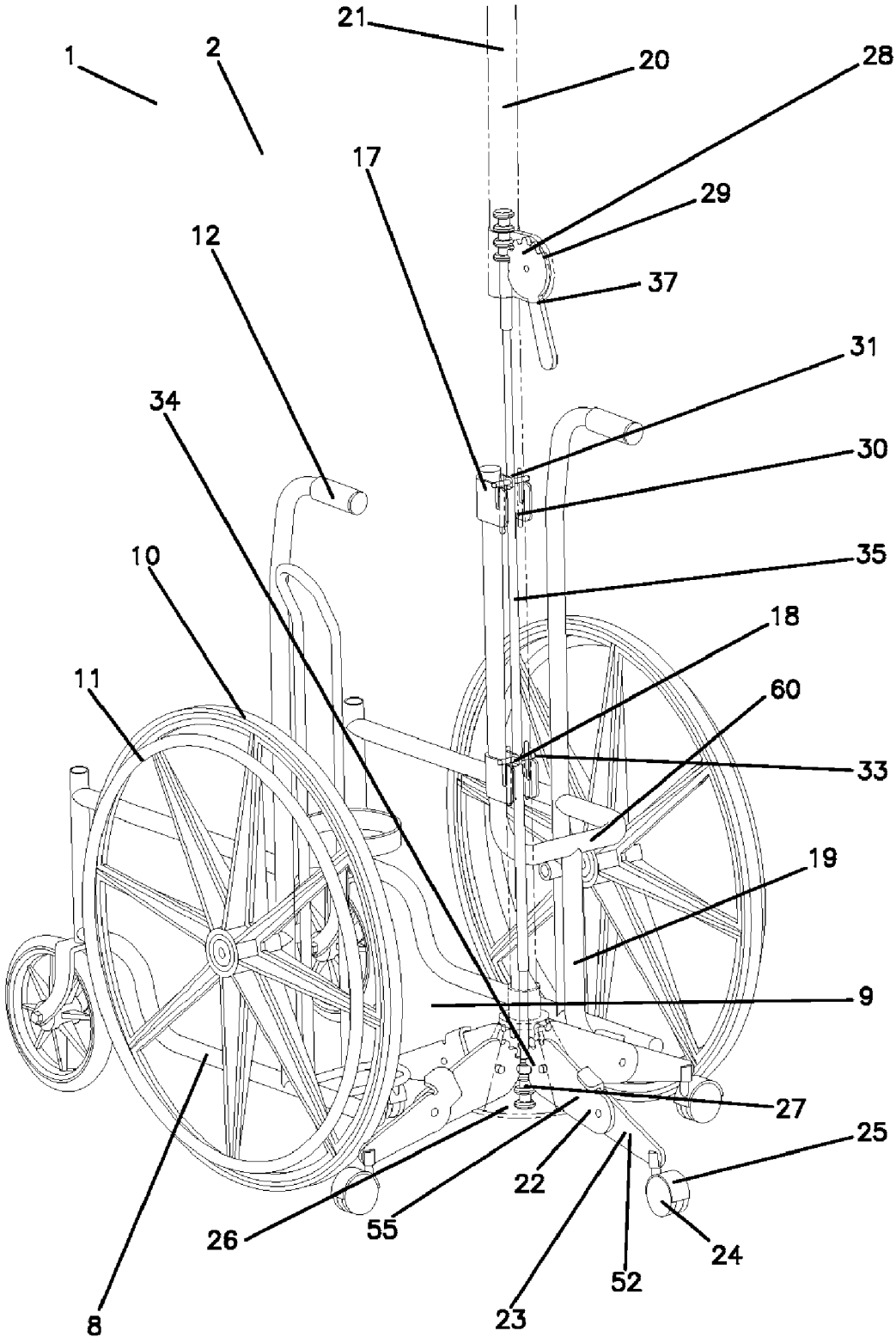
FIG. 1 is an isometric environmental view of one embodiment of a patient transfer device having an IV pole in accordance with the present invention.

A common form of patient transport device comprises a patient holding apparatus used together with a mobile IV pole. Mobile IV pole design is constrained by two contradictory physical requirements. Mobile IV poles must simultaneously have a base sufficiently wide so that the poles are stable and do not easily fall over, and which are sufficiently narrow so that the IV pole may be positioned adjacent to a patient holding apparatus such as a wheelchair, wheeled bed, stretcher, gurney, or the like. Lack of attention to either of these two design requirements may be problematic rendering the IV pole in-operable. An IV pole with a narrow base may be unstable and potentially fall over, which may either pull out an IV lead from a patient or cause other physical injury. In addition, the tipping over of an IV pole may result in the bag or pumps being positioned below the patient, resulting in poor or non-transfusion of needed fluids into the patient.

Alternatively an IV pole having a base which is overly wide may prevent the IV pole form being positioned proximate to the patient holding apparatus, and being cumbersome to move along with the patient holding apparatus. Articles such as: *Good Body Mechanics Are not Enough in Preventing Injury, Injury Preventing Products are Needed*, Nevada Nurses Association (May/July 2003), *American Nurses Association Launches 'Handle with Care' Ergonomics Campaign*, Nevada Nurses Association (November 2003), *The Prevalent Problem Associated with RN Back Injuries*, New Jersey's Nurse's Association (January/February 2005), and Deborah X. Brown, *Nurses and Preventable Back Injuries*, American Association of Critical-Care Nurses (2003), (all of which are hereby incorporated by reference in their entirety) all make clear that the need to constantly and repeatedly move patients with cumbersome equipment results in numerous sprain and back injuries in medical personnel.

Specifically with IV poles, if the pole and the patient holding apparatus are not close to each other, the medical personnel moving the patient will only have a single hand available to push the patient holding apparatus, as the other hand is needed to hold the IV pole. On average, a one handed push can exert between 24-35 lbs. of pushing force, while a two handed push can exert between 35-53 lbs. of pushing force. As evident, a significant level of efficiency is lost by only having a single hand available to push. This problem is exacerbated by the width of the base of an IV pole which separates the pole shaft from the handhold of the patient holding apparatus, forcing the user's two hands to be spaced widely apart. Constant and sustained pushing, while holding hands widely apart, impose further ergonomic stresses on the medical personnel moving the patient. In addition, the distance and stress increases the likelihood that the IV pole and the patient holding apparatus will move a sufficient distance apart so that the IV lead will be pulled from or will tug and harm the patient.

Physical stress injuries are a serious issue that imposes significant burdens on the medical industry. Nearly 52% of RNs (registered nurses) complain of chronic back injuries and 38% ultimately become disabled from these injuries. These injuries have resulted in about 750,000 lost nursing days, about $20 billion in additional medical costs (which contribute to more injuries in the personnel that treat them), and a loss of approximately 40,000 RNs each year. Thus novel devices that reduce strain and back injuries caused by transporting patients are not known or obvious and are sorely needed by the medical industry.

One such novel patient transportation device (1) is illustrated in FIG. 1 where there is shown a patient support apparatus (10) such as a wheelchair (11) and a wheeled IV pole (20). According to the prior art manner of transporting patients, one hand must hold at least one of the handles (12) while another hand must also hold the IV pole (20) along some part of its shaft. Because the base of a prior art IV pole is wide, the shaft of the IV pole (20) and the handles of the wheelchair (11) are not close to each other, leading to a cumbersome and awkward pushing experience. In addition, because typical wheelchair handles (12) are not centered and are instead positioned at the sides of the back, and are designed for two handed pushing, having only one hand available to push the wheelchair (11) is inefficient, stressful, and harmful to the pusher. These difficulties sometimes lead to the IV pole (20) and the wheelchair (11) not keeping pace with each other resulting in pulled or stretched IV leads. Embodiments contemplated by this invention include those in which one, some, or all of the various components of the patient transportation device (1) are constructed at least partially out of metal and/or a high temperature or impact plastic including but not limited to Polyetheretherkeytone (P.E.E.K.), RADEL, ULTEM, and/or UDEL.

Figure 2:
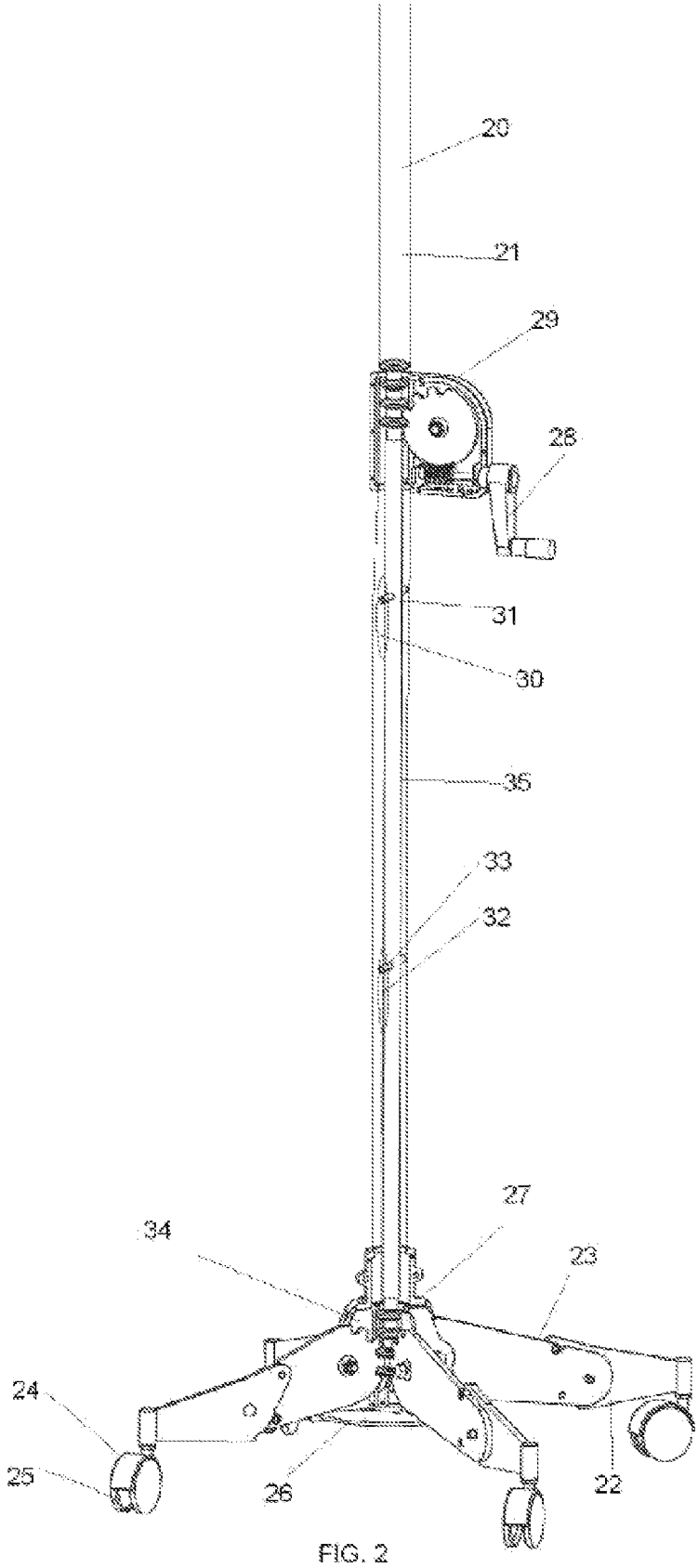
FIG. 2 depicts a detailed perspective view of one exemplary embodiment of an IV pole in accordance with the present invention.

Referring now to FIGS. 1 and 2 there is shown at least one embodiment of the invention where a patient transportation device (1) comprises an IV pole (20) having a transformable wheel base (22) at the bottom of the pole shaft (21). The wheel base (22) comprises one or more legs (23) supported by one or more wheels (24). The longer the wheel base (22) the more stable the IV pole (20) can stand. In at least one embodiment, the IV pole (20) includes a base (22) with four legs (23) engaged to four wheels (24). In at least one embodiment the wheels (24) are within wheel casters (25). In at least one embodiment at the bottom of the shaft (21) is a bottom plate (26). In at least one embodiment, at least a portion of the shaft (21) is hollow.

The IV pole (20) utilizes a raising/lowering mechanism (27) to alternatively raise or lower the legs (23). Raising the legs (23) reduces the width of the wheel base (22) allowing the shaft (21) of the pole (20) to be positioned more close to a patient supporting apparatus (10 of FIG. 1) of the patient transportation device (1 of FIG. 1). In at least one embodiment, the raising/lowering mechanism (27) works in conjunction with one or more cranks (28) working with one or more upper gears (29), one or more lower gears (34) and one or more pins (31, 33) to raise or lower the wheels (24).

In at least one embodiment of the invention, one or more lower gears (34) are securely coupled to an upward extending inner rod (35) positioned within a hollow of the shaft (21). The inner rod (35) is also connected to an upper rod pin (31) and a lower rod pin (33). The inner rod (35) pulls the wheel base (22 in FIG. 2) upwardly as the inner rod (35) as it is elevated by the crank (28) within the hollow shaft (21). The inner rod (35) pushes the wheel base (22 in FIG. 2) down as the inner rod (25) is moved downwardly by the crank (28). An upper slot (30) defined by the walls of the hollow in the shaft (21) may at least partially limit the upward-downward motion of the inner rod (35) relative to the shaft (21) by limiting the motion of the upper pin (31) that extends through it. A lower slot (32) defined by the walls of the hollow in the shaft (21) limits the upward-downward motion of the inner rod (35) relative to the shaft (21). The limitation on motion imposed by the pins (33, 31) prevents the inner rod (35) from being excessively elevated or lowered relative to the shaft (21). The pins (33, 31) establish a proper range of motion by the wheel base (22 in FIG. 2). In one embodiment upper leg raising/lowering gears crank (28) is connected to the upper leg raising/lowering gears (27 in FIG. 2) through the use of a screw/pin. Alternative engagement mechanisms can also be used herein.

Figure 3:
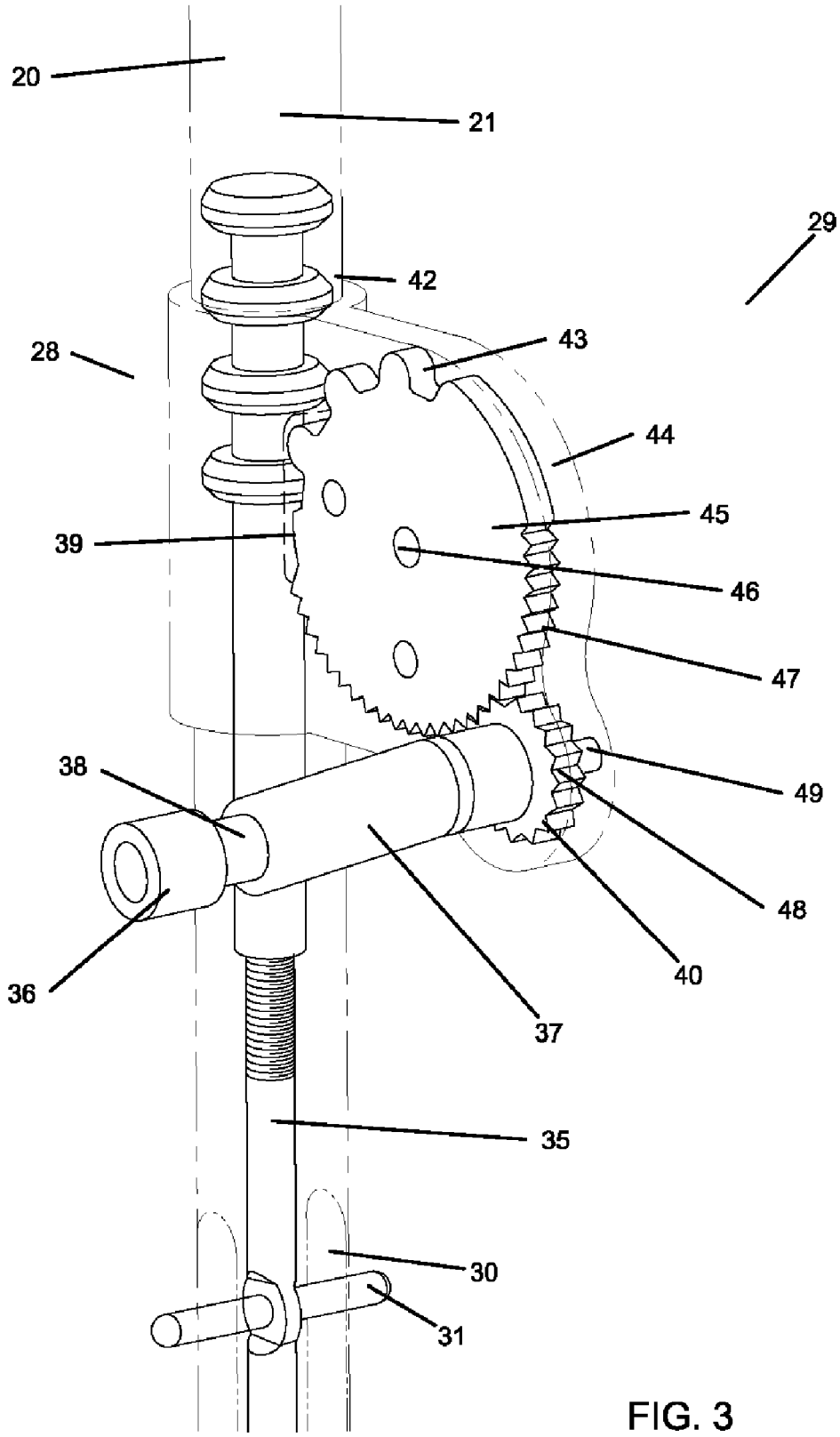
FIG. 3 is a detailed perspective cut away view of an IV pole's upper leg raising/lowering gears, leg raising/lowering gears crank, inner rod, inner rod upper pin, and inner rod upper pin slot.

Referring now to FIG. 3 there is shown a detailed view of one embodiment of the upper gears (29) for raising and lowering the wheel base. The crank handle (36) is connected to the crank rod (37) with the crank handle screw/pin (38). Likewise, crank rod (37) is connected to minor gear (48) with crank rod screw/pin (49). Minor gear small grooves (40) are cut into the entire circumference of minor gear (48). Minor gear (48) is connected to major gear (45). These minor gear small grooves (40) are inter-connected with major gear small grooves (47) (which only constitute half of the major gear's (45) circumference). Minor gear (48) is able to spin around the crank rod screw/pin (49).

Major gear (45) is able to spin around major gear screw/pin (46). Major gear (45) and minor gear (48) are both enclosed by the major and minor gear casing (44). On the other half of the major gear's (45) circumference there are major gear big grooves (43) cut into major gear (45). These big grooves (43) then inter-connect with inner rod upper gear (42) (which is part of inner rod (35)) through a slit (39) in the IV pole (20). Also connected to the inner rod (35) is inner rod upper pin (31). This pin (31) is then able to slide up and down through the inner rod upper pin slots (30).

Through the cranking motion caused by cranking crank handle (36), the minor gear (40) spins, thus causing major gear (45) to spin. Simultaneously major gear (45) causes inner rod upper gear (42) to move up/down. As inner rod upper gear (42) is vertically connected to inner rod (35), inner rod (35) is consequently moved up/down as well. In the embodiment depicted in FIG. 3, clockwise rotation of the crank handle (36) lowers the inner rod (35) and counter-clockwise rotation of crank handle raises inner rod (35).

Figure 4:
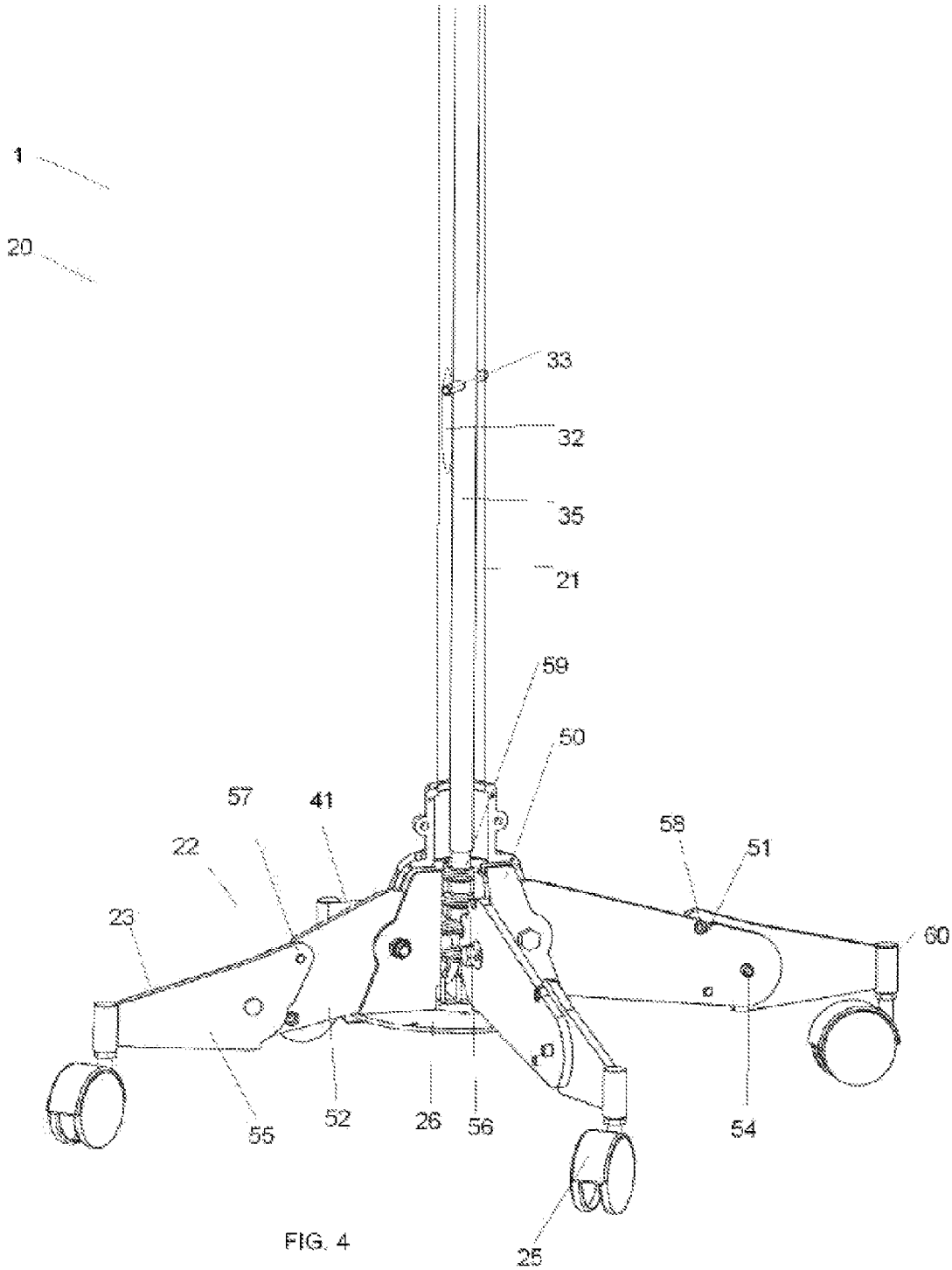
FIG. 4 is a detailed partial cut away view of an IV pole's lower leg raising/lowering gears, inner rod lower pin, inner rod lower pin slot, four legs and four wheel casters, and IV pole bottom plate.
Figure 5:
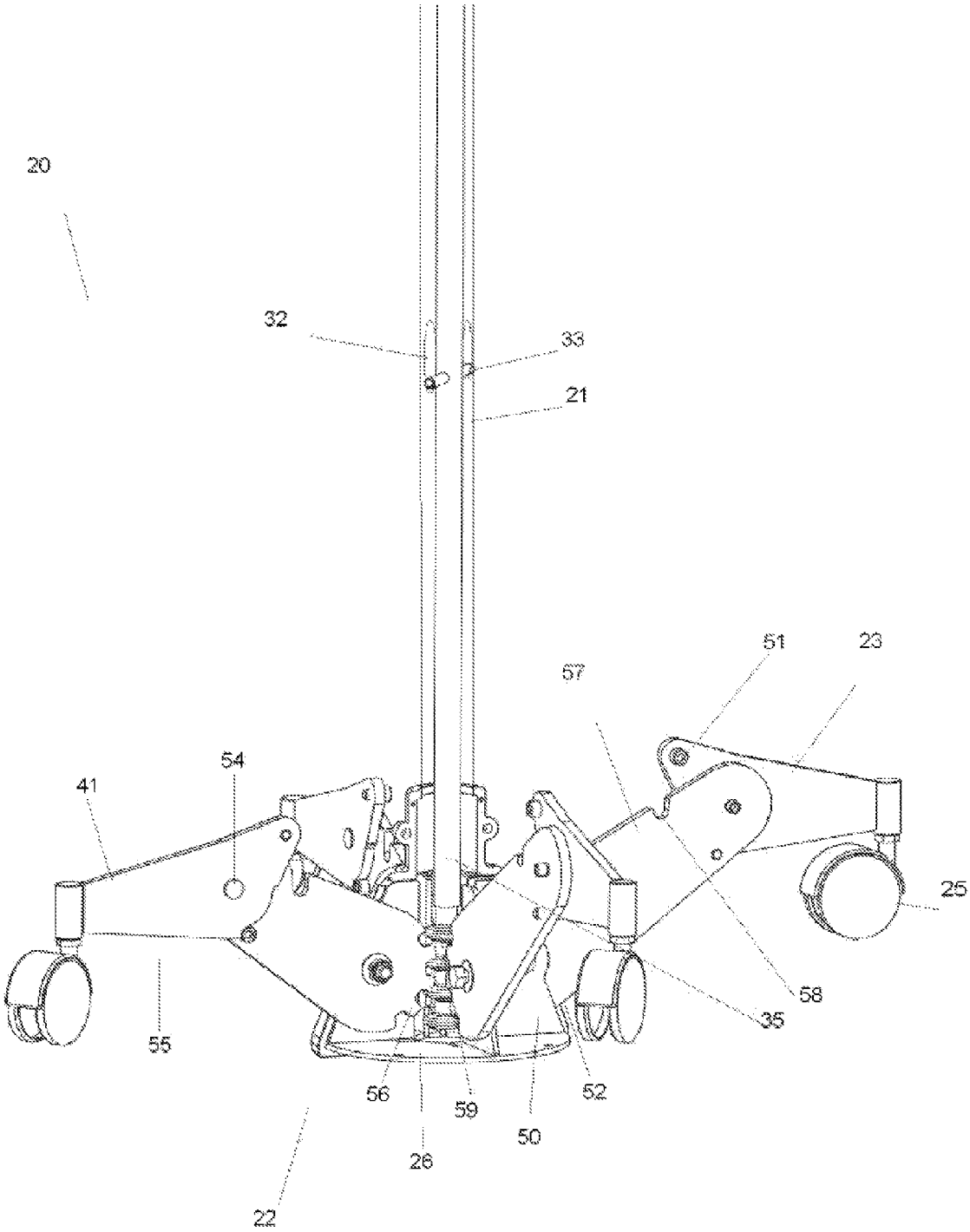
FIG. 5 is a detailed perspective close up view of FIG. 4 with an IV pole's legs in the raised position.

Referring now to FIGS. 4 and 5 there are shown a detailed view of the wheel base (22) of one embodiment of the invention. FIG. 4 illustrates the wheel base (22) extended downward and outward to increase the stability of the IV pole (20). FIG. 5 illustrates the wheel base (22) retracted upwardly and inwardly to allow the shaft (21) to be positioned more closely to the patient holding apparatus (10 in FIG. 1). The wheel base (22) comprises two or more movable leg segments (41). FIG. 4 illustrates four legs (23) comprised of two leg segments (41) one being an outer leg (55) which is movably connected to the other inner leg (52).

Figure 18:
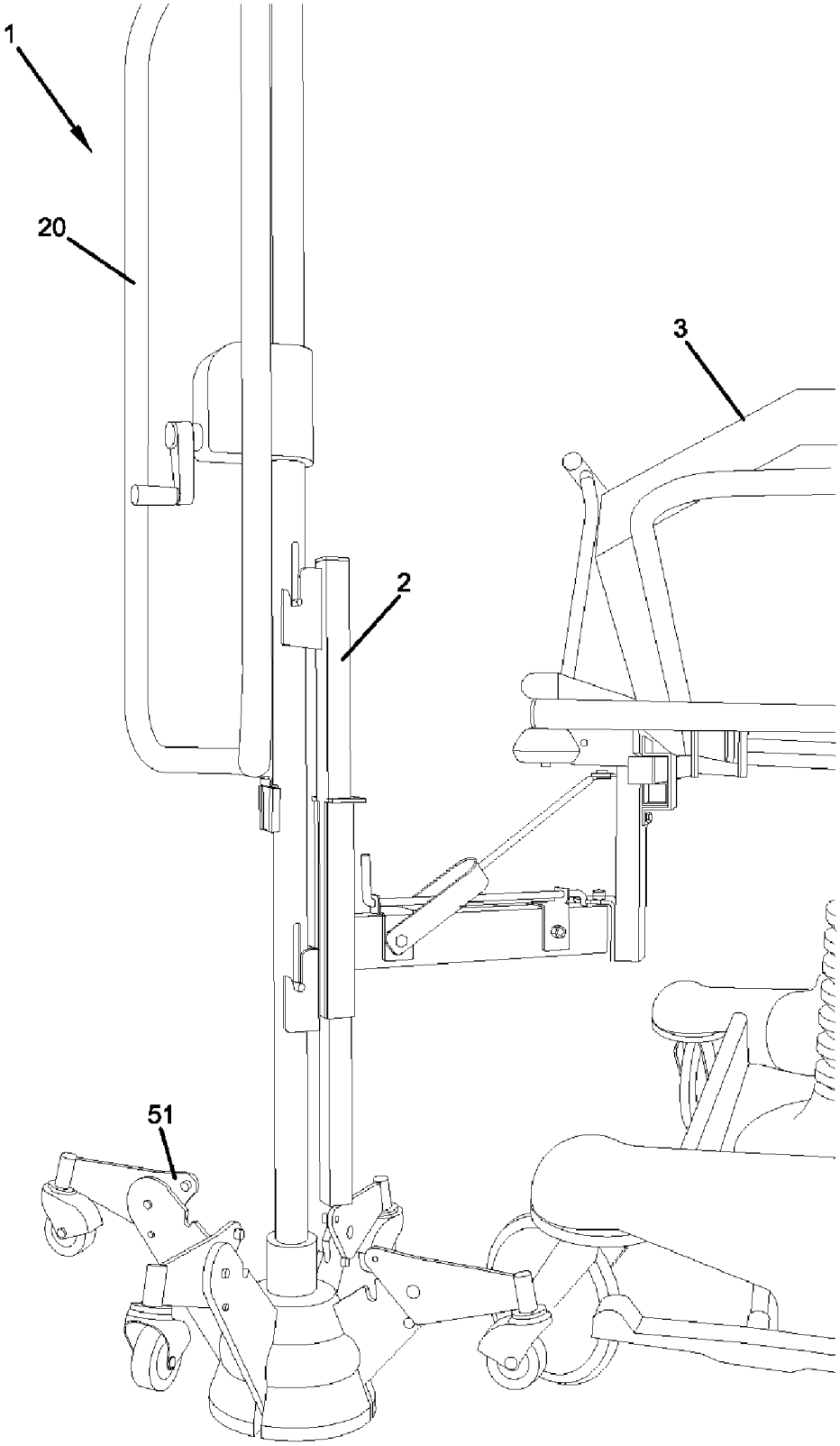
FIG. 18 is an alternative detailed environmental view of an IV pole connected to a hospital bed with the wheels raised.

In at least one embodiment, the outer leg (55) and inner leg (52) are held together by a leg screw/pin (54). This leg screw/pin (54) allows outer leg (55) to pivot. The outer leg's (55) pivot is prevented from doing a full 360-degree pivot in two ways. First the outer leg (55) has two stops connected to it, outer leg upper stop (57) and outer leg lower stop (51) (which is also shown in FIG. 18). Outer leg upper stop (57) prevents the bottom plate (26) from collapsing downward when the IV pole (20) is in its upward standing position. This is done by the outer leg upper stop (57) resting in the inner leg trough (58). The outer leg lower stop (51) prevents the outer leg (55) and the wheel caster (25) from collapsing under the bottom plate (26) whenever the IV pole (20) is manually picked up to move or when the IV pole is raised off the ground and engaged to a patient holding apparatus (10 in FIG. 1).

Also shown in FIG. 4 is the inner leg gear grooves casing (50). This casing conceals the inner leg gear grooves (56) that are cut into one end of the inner leg (52). These gear grooves (56) work in conjunction with the inner rod lower gear (59) which is vertically connected to the inner rod (35). Each of the four legs (23) meet with the inner rod lower gear (59) and then spoke outwards. Although FIGS. 4 and 5 illustrate a wheel base in which the legs (23) are of identical length, the invention contemplates an embodiment in which one or more legs have a longer or shorter length than one or more of the other legs (23) having the same or dissimilar leg lengths, which may allow one side of the IV pole (20) (corresponding to the shorter leg(s)) to be moved closer to a patient support apparatus (10 in FIG. 1) while the other side of the IV pole (20) (corresponding to the longer leg(s)) may provide greater stabilization to the overall patient transportation device (1 in FIG. 1).

The cranking action described in FIG. 3 causes the inner rod (35) and the inner rod lower gear (59) to move up/down. Referring now to FIG. 4, the movement of the inner rod (35) rotates the inner leg gear grooves (56) which consequently invert the inner leg (52). This action simultaneously raises the outer legs (55) and the wheel casters (25). The pivoting action allowed by the leg screw/pin (54) allows the outer leg (55) to collapse downward to a certain point when it is then stopped by the outer leg lower stop (51).

Also shown in FIG. 4 are the inner rod lower pin (33) and the inner rod lower pin slots (32). The inner rod lower pin (33) is similar to the inner rod upper pin (31 in FIG. 3) and is also connected to the inner rod (35) and the inner rod lower pin slots (32) are similar to the inner rod upper pin slots (30 in FIG. 3) and are openings defined by the wall of a hollow portion of the shaft (21). The inner rod lower pin (33) moves up/down in conjunction with the inner rod (35), which is caused by the same cranking action previously described.

FIG. 5 shows the wheel base of FIG. 4 with the inner legs (52) in their inverted position as a result of the cranking motion caused by manipulation of the crank handle (36 in FIG. 3). As the outer leg (55) swings downwardly by pivoting around the leg screw/pin (54), it is prevented from fully collapsing down by the outer leg lower stop (51).

Also seen in FIG. 5 is the inner rod lower pin (33) and the inner rod lower pin slots (32). In this position (with the inner legs (52) inverted) the inner rod lower pin (33) is in its downward position, which is at the bottom of the inner rod lower pin slots (32).

Figure 6:
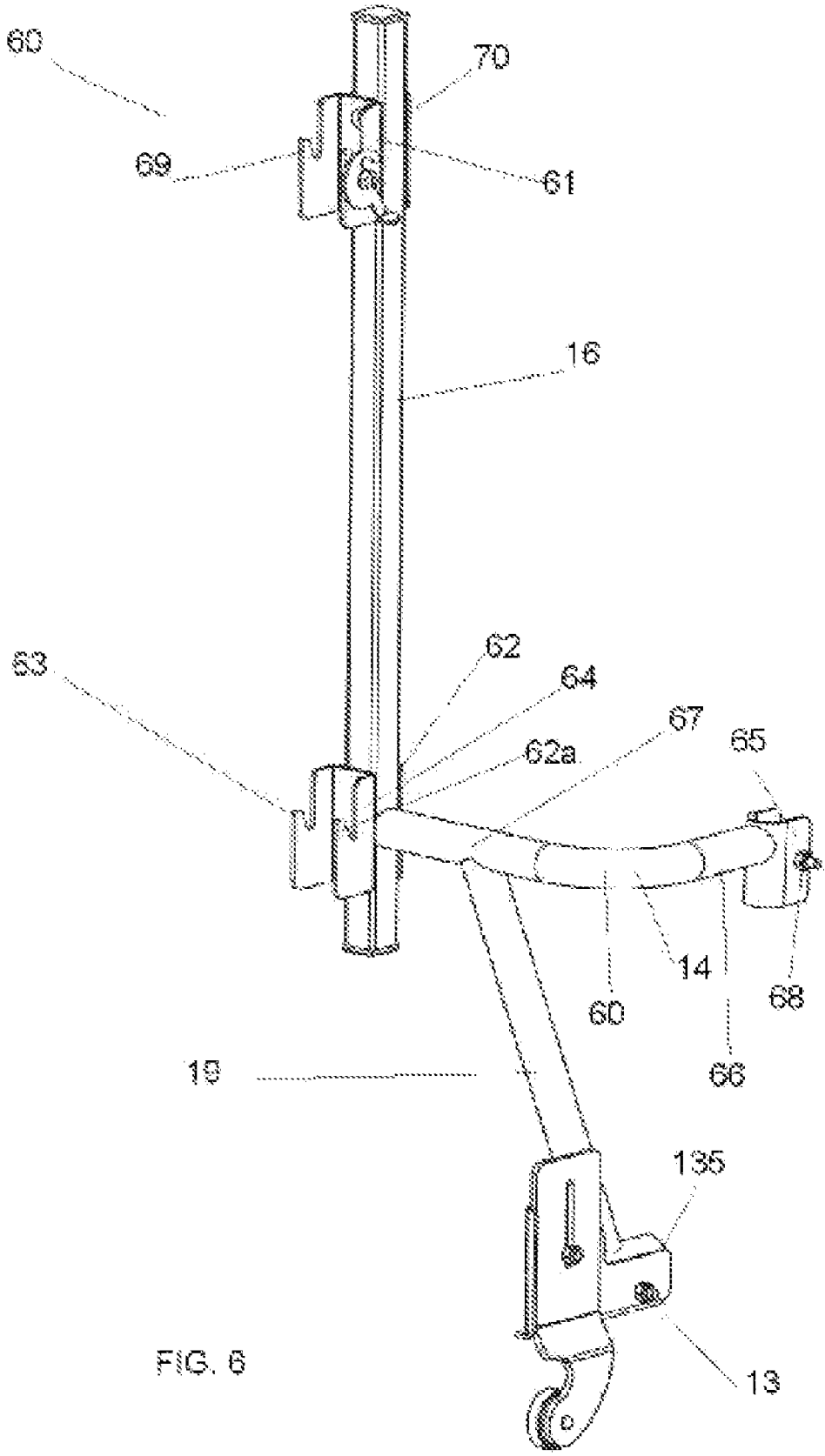
FIG. 6 is a detailed perspective view of a wheelchair attachment for the IV pole.

Referring now to FIG. 6 there is shown a wheelchair attachment (60) designed to be attached to industry standard sized wheelchairs as well as non-standard wheelchairs. An IV pole (10 in FIG. 2) can be elevated, secured in, and supported by one or more connectors (70, 64) in the attachment (60). Such support allows the wheelchair and IV pole to be moved together more easily by one person and even with only one hand while holding either the wheelchair or the IV pole with that one hand.

In at least one embodiment of the invention, the attachment (60) comprises two connectors, an upper connector (70) and a lower connector (64). This is achieved by the upper and lower inner rod pins (31 and 33 in FIG. 2) resting securely in the upper connector trough (69) and the lower connector troughs (63) respectively.

FIG. 6 illustrates a wheelchair attachment (60) that works in conjunction with the IV pole (20) of FIG. 2. The wheelchair attachment (60) is connected to a wheelchair in two places, the upper clamp (65) and the lower clamp (53). Each clamp (65, 53) is attached to a bar on the wheelchair (for example 8 in FIG. 1). In at least one embodiment, the clamps (65, 53) are secured to the wheelchair bars (8 in FIG. 1) with one or more clamp screws (68, 13) such as upper clamp screw (68) and lower clamp screw (13).

In at least one embodiment, the attachment comprises a lower bar (19) spanning between the lower clamp (53) and the remainder of the attachment (60). The lower bar (19) can act as a weight support for the wheelchair attachment (60). Likewise, in at least one embodiment a middle bar (66) spans between the upper clamp (65) and the remainder of the attachment (60). The middle bar (66) can bend along a curve from a direction oriented away from the back of the wheelchair (11 in FIG. 1) to a direction oriented towards the IV connectors (70 and 64).

In at least one embodiment the middle bar (66) horizontally curves up to or beyond 90° (90 degrees) at a 90-degree horizontal bend (14). The middle bar (66) then vertically curves upward at the 90-degree vertical bend (15). In-between the 90-degree horizontal bend (14) and the 90-degree vertical bend (15) the lower bar (19) vertically and diagonally meets the middle bar (66) at the middle/lower bar intersection (67). After the 90 degree vertical bend (15) the middle bar (66) continues upward vertically becoming upper bar (16). Upper bar (16) has two pieces connected to it, upper connector (70) and lower connector (64). These two connectors are the same distance apart as the inner rod upper and lower pins (31 and 33 in FIG. 2).

In at least one embodiment, upper and lower connectors (70 and 64) are attached to the upper bar (16) by an upper connector weld, screw, or other form of connection (61) and lower connector weld, screw, or other form of connection (62). In at least one embodiment, the upper and lower connectors (70 and 64) are bent around the upper bar (16) to form a "u" shape. Each tip (62*a*) (there are two tips per connector) of the "u" shaped upper and lower connectors (70 and 64) have vertically cut into them connector troughs (39 and 63). The upper connector (70) has the upper connector trough (69) cut into it and the lower connector (64) has the lower connector trough (63) cut into it.

FIG. 1 depicts the way the wheelchair attachment (60) is connected to the wheelchair (10) as well as the way the IV pole (20) is connected to the wheelchair attachment (60) for patient transporting. The upper pin/trough connection (17) and the lower pin/trough connection (18) is made possible by rolling the IV pole (20) in-between the two tips of the "u" shaped upper and lower connectors (70 and 64). The inner rod upper pin (31) and the lower rod pin (33) are then positioned just above the upper and lower connector troughs (69) and (63). Embodiments contemplated by this invention include IV poles (20) whose wheels remain in contact with the ground when the IV pole (20) is engaged to the wheelchair (10) as well as IV poles (20) whose wheels are retracted up off of the ground when the IV pole (20) is engaged to the wheelchair (10).

In at least one embodiment, a freestanding IV pole (20) is guided up to the mount (60) such that the pins (31 and 33 of FIG. 2) are positioned just above the troughs (69 and 63 of FIG. 6). By using the crank (28) the pins (33, 31) are lowered into the troughs (69, 63) while the legs (23) are retracted upwards off the ground and occupy a smaller area. The conclusion of this process results in the pins (31, 33) resting at the bottom of the troughs (69, 63) and the legs (23) being lifted completely off the ground.

By then using the previously described cranking action caused by cranking the crank handle (36) (or the lever type gear (37) of FIG. 1) the inner rod (35) is then lowered from its elevated position. The inner rod upper and lower pins (33, 33) then move down as well, resting in the upper and lower connector troughs (69, 63). Simultaneously the four inner legs (52) are inverted, thus raising the four outer legs (55) and the four wheels off of the ground. The end result of the previously described action, caused by simply cranking the crank handle (37), is that the patient's IV pole (20) is elevated completely off the ground and secured into the upper and lower connector troughs (69, 63).

Figure 16:
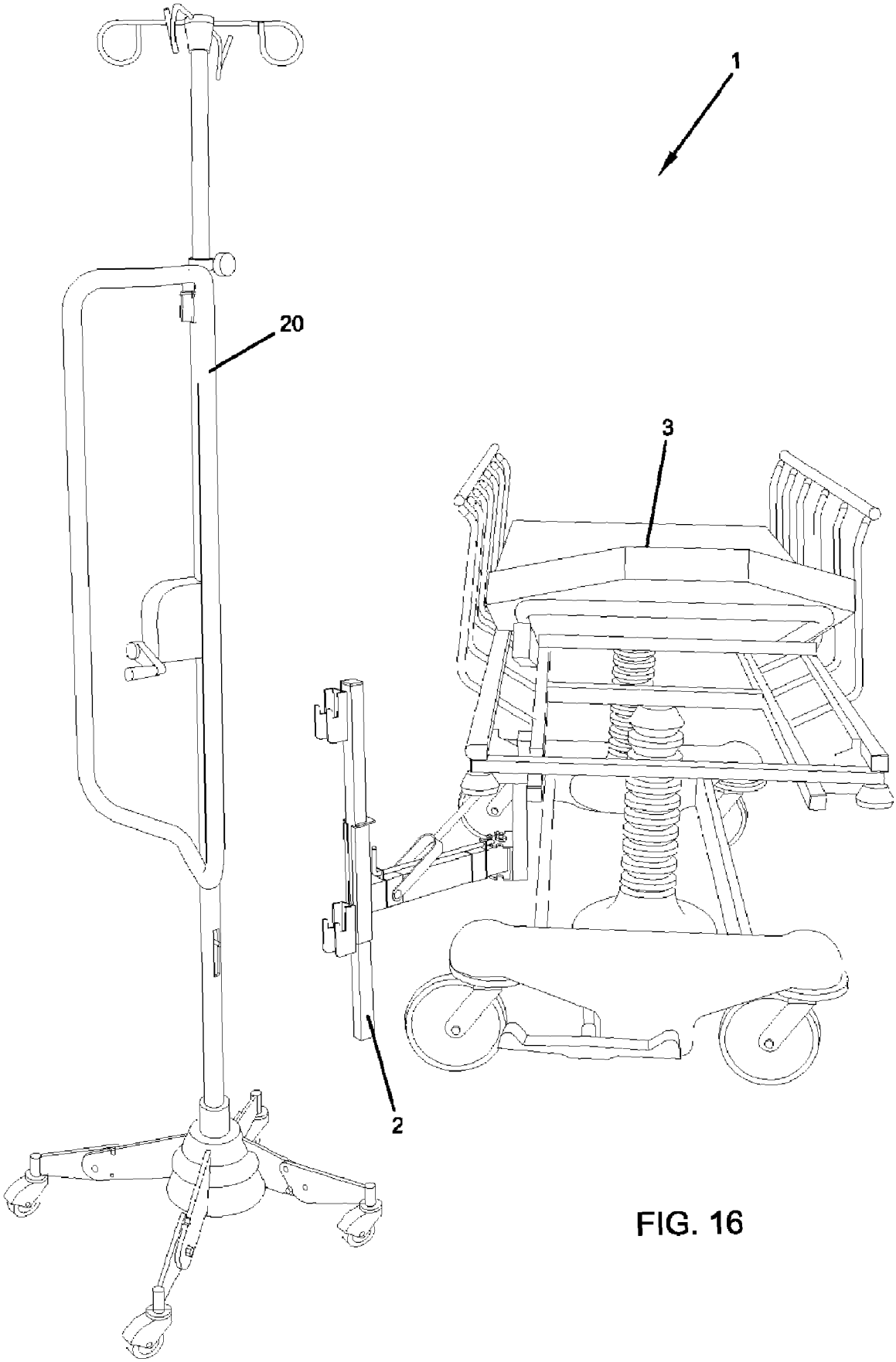
FIG. 16 is an alternative environmental view of an IV pole not connected to a hospital bed.
Figure 17:
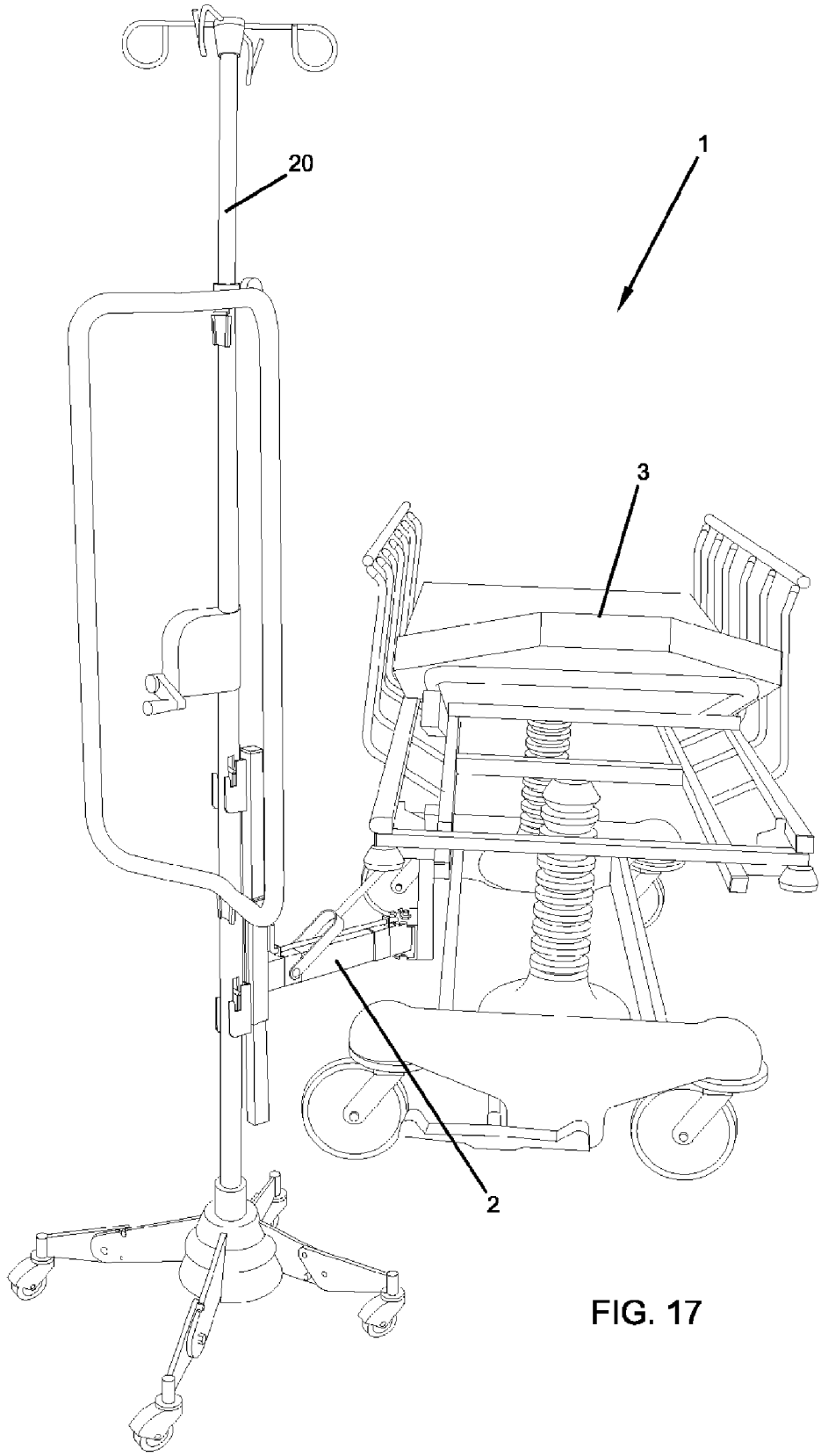
FIG. 17 is an alternative environmental view of an IV pole connected to a hospital bed.
Figure 19:
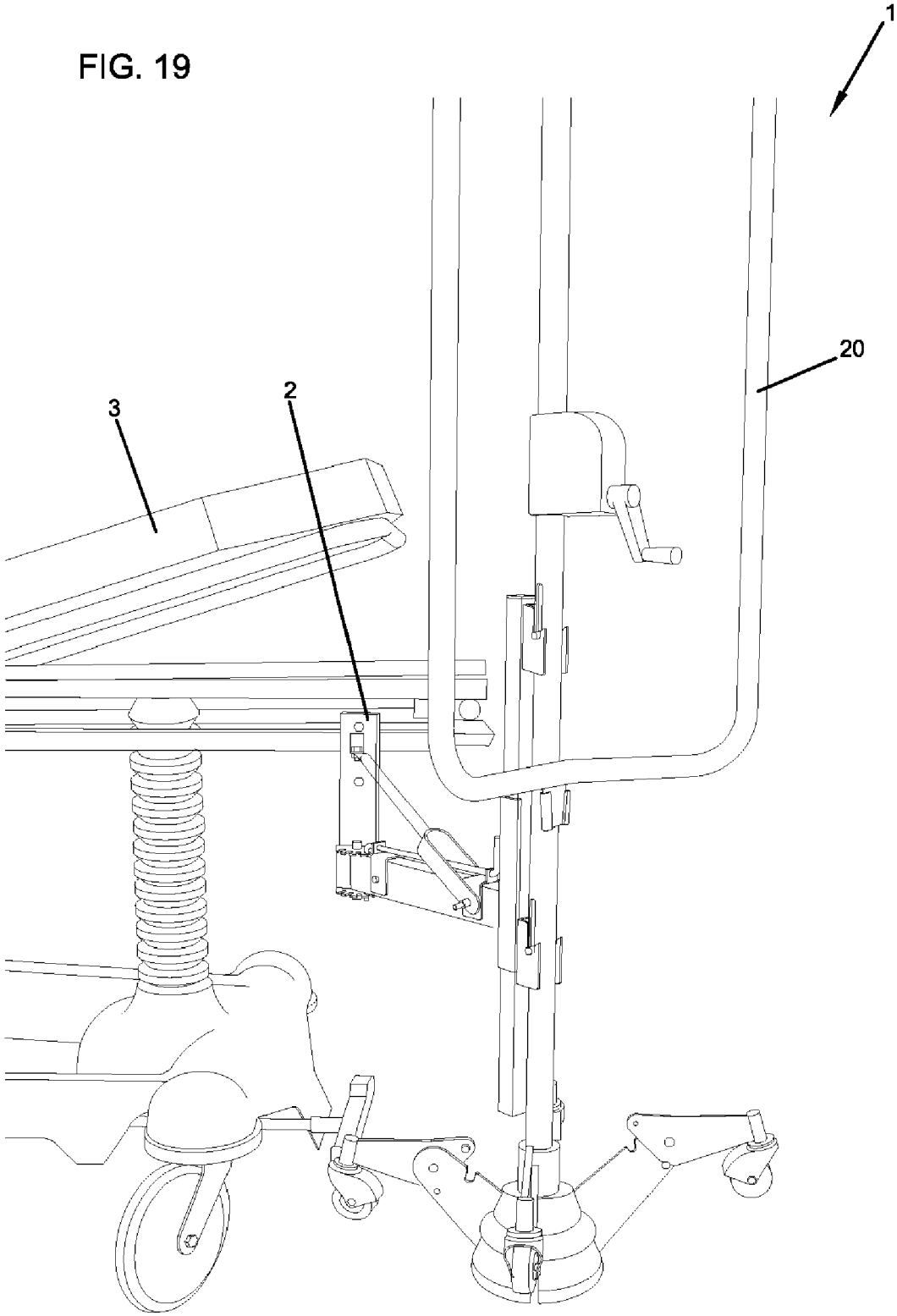
FIG. 19 is an alternative detailed environmental view of an IV pole connected to a hospital bed with the wheels raised.
Figure 20:
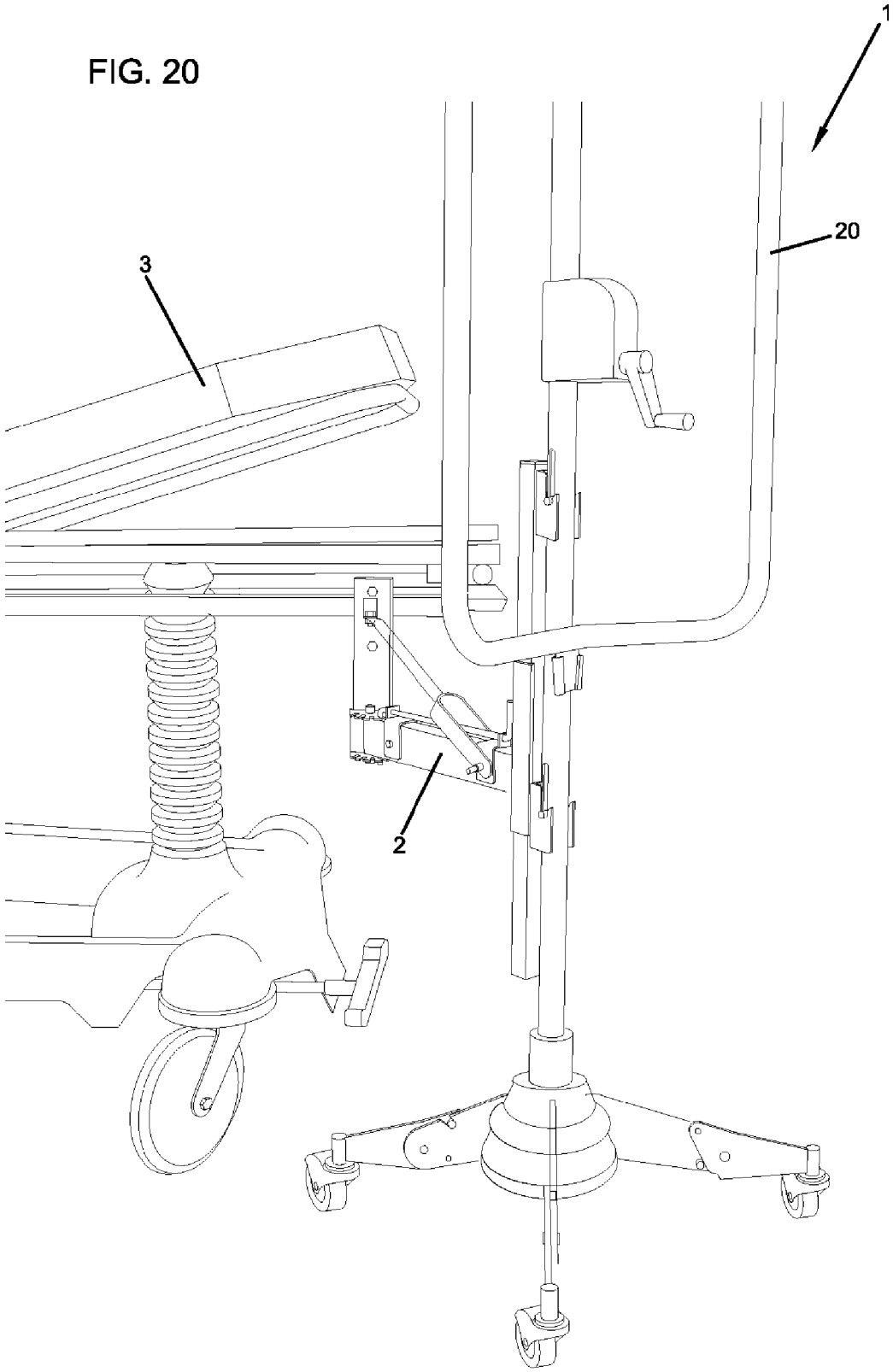
FIG. 20 is an alternative detailed environmental view of an IV pole connected to a hospital bed with the wheels lowered.

FIGS. 16-20 illustrate an embodiment of the invention in which the patient transportation device (1) is a bed or gurney (3) capable of engagement to an IV pole (20) by a bed/gurney attachment (2). FIG. 16 shows the IV pole (20) when it is not engaged to bed/gurney attachment (2). FIGS. 17 and 20 shows the IV pole (20) when it is engaged to bed/gurney attachment (2) and the wheels are down. FIGS. 18 and 19 shows the IV pole (20) when it is engaged to bed/gurney attachment (2) and the wheels are retracted upward.

Figure 7:
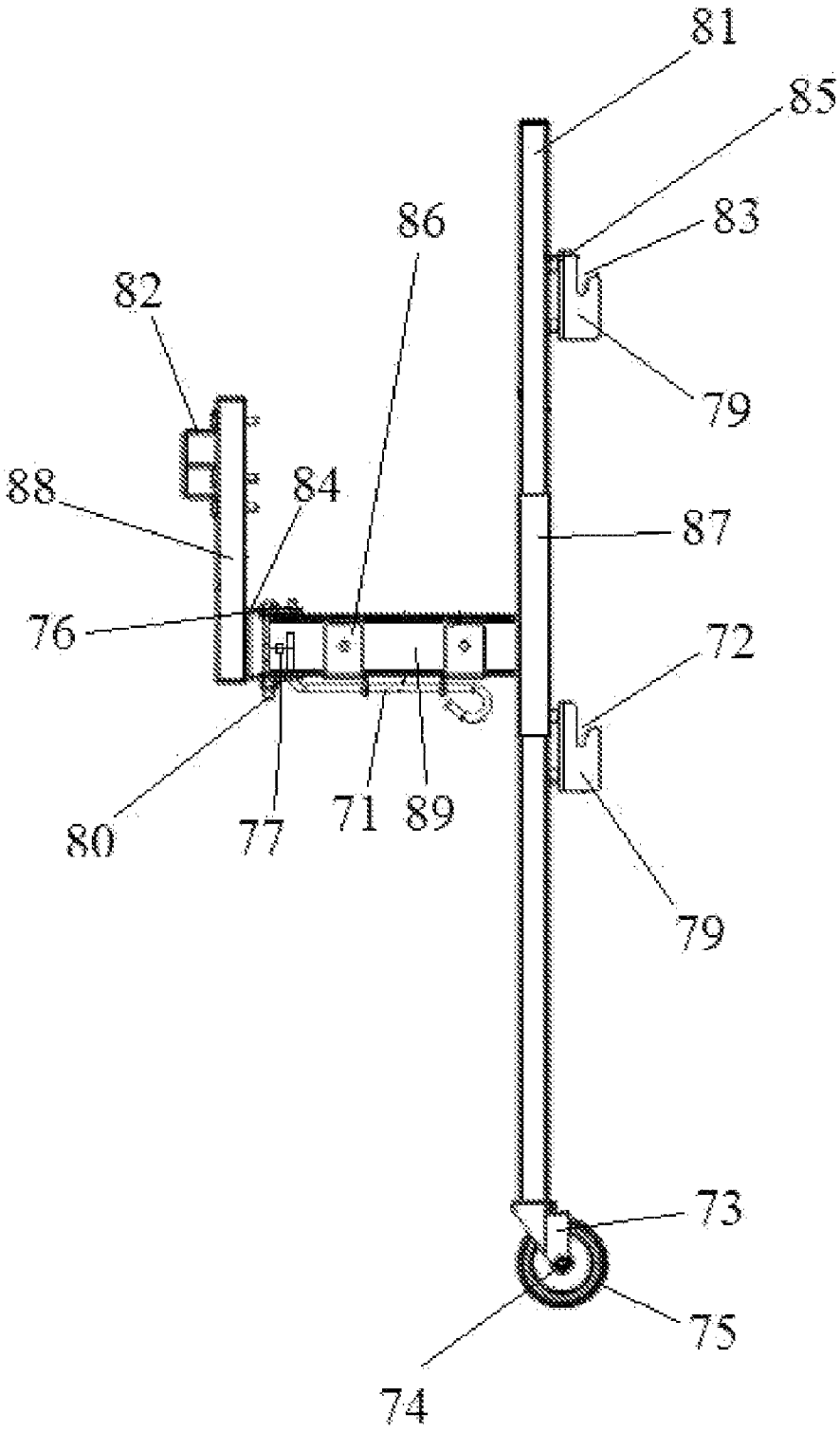
FIG. 7 is a detailed side view of a bed/gurney attachment as used in some embodiments before the wheels are lifted and the bed/gurney attachment supports the suspended IV pole.

Referring now to FIG. 7 there is shown a detailed illustration of one embodiment of the bed/gurney attachment (2). The bed/gurney attachment (2) is connected to a bed/gurney by connection of the bed mount connector (82) to the bed/gurney. The bed mount connector (82) is able to fit various size bars and is secured to the upper portion of the minor vertical bar (88) by screwing the bed mount connector (82) to the back of the minor vertical bar (88).

At the bottom of the minor vertical bar (88) the arm pivot bracket (84) is engaged to the lower portion of the minor vertical bar (88) which is opposite to the upper bed mount connector (82). The engagement of the arm pivot bracket (84) may be accomplished by welding. The arm pivot bracket (84) then receives the arm (89) which is secured into place by the arm pivot screw/pin (80). The arm pivot screw/pin (80) allows for a 180 degree rotation of the arm (89). However, the arm (89) is held into a stable position by the arm release hook and pin (71) and is only able to pivot when the arm release hook and pin (71) is retracted from the arm pivot bracket notch (76). There are three arm pivot bracket notches (76). Although FIG. 7 depicts an embodiment in which the slotted mount (109) has five slots allowing for five pivoting positions, more or fewer slots which would allow for a respectively equal, more, or fewer pivoting positions are contemplated by this invention. The positioning of each of the notches allows the arm (89) to travel from a zero-degree position (along the side of the bed/gurney), to a 90-degree position (perpendicular to the bed/gurney), and then to a 180-degree position (again along the side of the bed/gurney in the other direction than the zero-degree position). Contemplated embodiments also include bends in any of these components of between 0 and 180 degrees and specifically of 0, 45, 90, 135, and 180 degrees. The arm release hook and pin (71) has constant tension pulling it into the arm pivot bracket notches (76) from the arm release hook and pin spring (77).

This arm release hook and pin spring (77) is suspended between and connected to both the arm pivot screw/pin (80) and the arm release hook and pin (71). The arm release hook and pin (71) is connected to the arm (89) by the arm release hook and pin mount (86). This mount (86) is secured to the sides of the arm (89) and allows the arm release hook and pin (71) to travel through two rings that form a portion of the arm release hook and pin mount (86). Contemplated embodiments also include one in which the major vertical bar sleeve (87) can also be fixed into place relative to its engagement to the major vertical bar (81). Such fixation can be accomplished through the use of screws, protruding through the screw holes depicted in FIG. 11.

Also seen in FIG. 7 is at least one embodiment having a major vertical bar sleeve (87) and a major vertical bar (81). The major vertical bar sleeve (87) is connected to the opposite end of the arm (89) as related to the arm pivot bracket (84). The major vertical bar sleeve (87) runs vertically and only covers a small portion of the major vertical bar (81) at any given time. Running vertically through, and independent from, the major vertical bar sleeve (87) is the major vertical bar (81). The major vertical bar (81) stands approximately 40-inches tall from the ground to the top. The major vertical bar sleeve (87) is independent from the major vertical bar (81) in order to allow the bed/gurney (3 in FIG. 16) to be set at different heights without affecting the set height of the major vertical bar (81). Having the major vertical bar (81) run vertically through the major vertical bar sleeve (87) allows for a free flowing vertical movement of the previously described portion of the bed/gurney attachment (2) while there is simultaneously no vertical movement of the major vertical bar (81).

Also depicted in FIG. 7 is at least one embodiment having additional components. There is an upper connector (78) and a lower connector (79) which are positioned at a set distance apart, (and off of the ground) as the previously described analogous upper and lower troughs (69 and 63 in FIG. 6) in the wheelchair attachment (60) of FIG. 6. The upper and lower connectors (78 and 79) also define upper and lower connector troughs (83 and 72) (which are analogous to the upper and lower connector troughs of FIG. 6). This allows the bed/gurney attachment (2) to receive the same inner rod upper and lower pins (31 and 33 from FIG. 2) that are part of the IV pole (20 of FIG. 1) The upper and lower connectors (78 and 79) are engaged to the major vertical bar (81) by the upper and lower connector pins (85).

The embodiment illustrated in FIG. 7 (in contrast to FIGS. 16-20), further comprises a wheel assembly at the bottom of the major vertical bar (81). The wheel assembly comprises a wheel joint (73), a wheel/joint screw (74), and a bed mount wheel (75). The wheel joint (73) is directly attached to the bottom of the major vertical bar (81). It is then attached to the bed mount wheel (75) via the wheel/joint screw (74). The wheel joint (73) allows for a full 360-degree rotation of the bed mount wheel (75) for maximum mobility.

Figure 8:
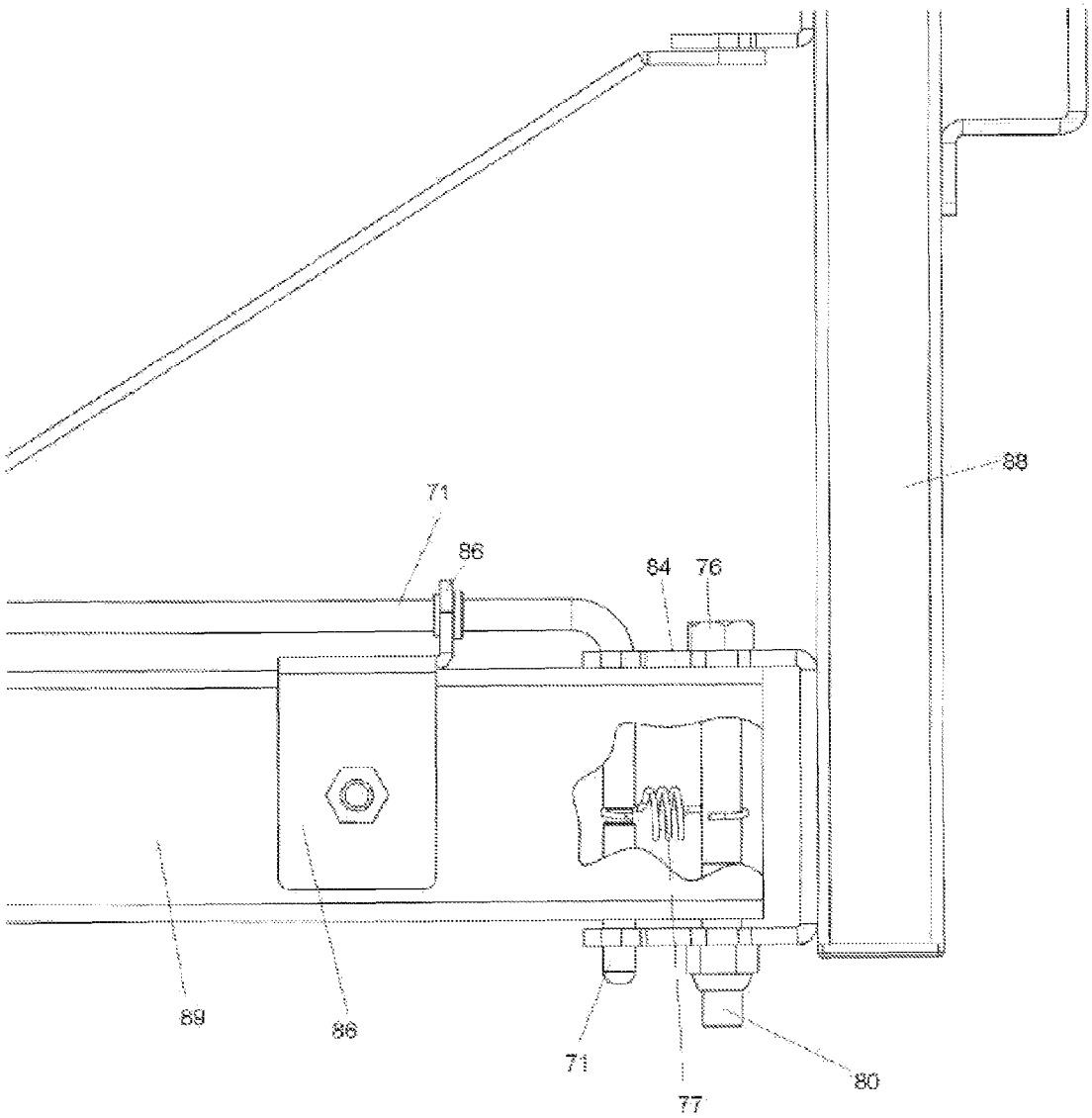
FIG. 8 is a lateral detailed view of a bed/gurney attachment for an IV pole.

FIG. 8 is a detailed view of the pivoting point, of FIG. 7, where the arm (89) is able to pivot at the arm pivot bracket (84) point. FIG. 7 depicts one embodiment as to how the arm pivot bracket (84) is connected to the bottom portion of the minor vertical bar (88), and then how the arm pivot bracket (84) couples the arm (89) with the arm pivot screw/pin (80). Also seen is the arm release hook and pin mount (86), the arm release hook and pin (71) (however the hook portion is not shown) and how they work in conjunction with the arm pivot bracket (84) (allowing release from the arm pivot bracket notches (76)). Also depicted is the tension pulling the arm release hook and pin (71) which is poisoned into the arm pivot notches (76) by the arm release hook and pin spring (77).

Figure 11:
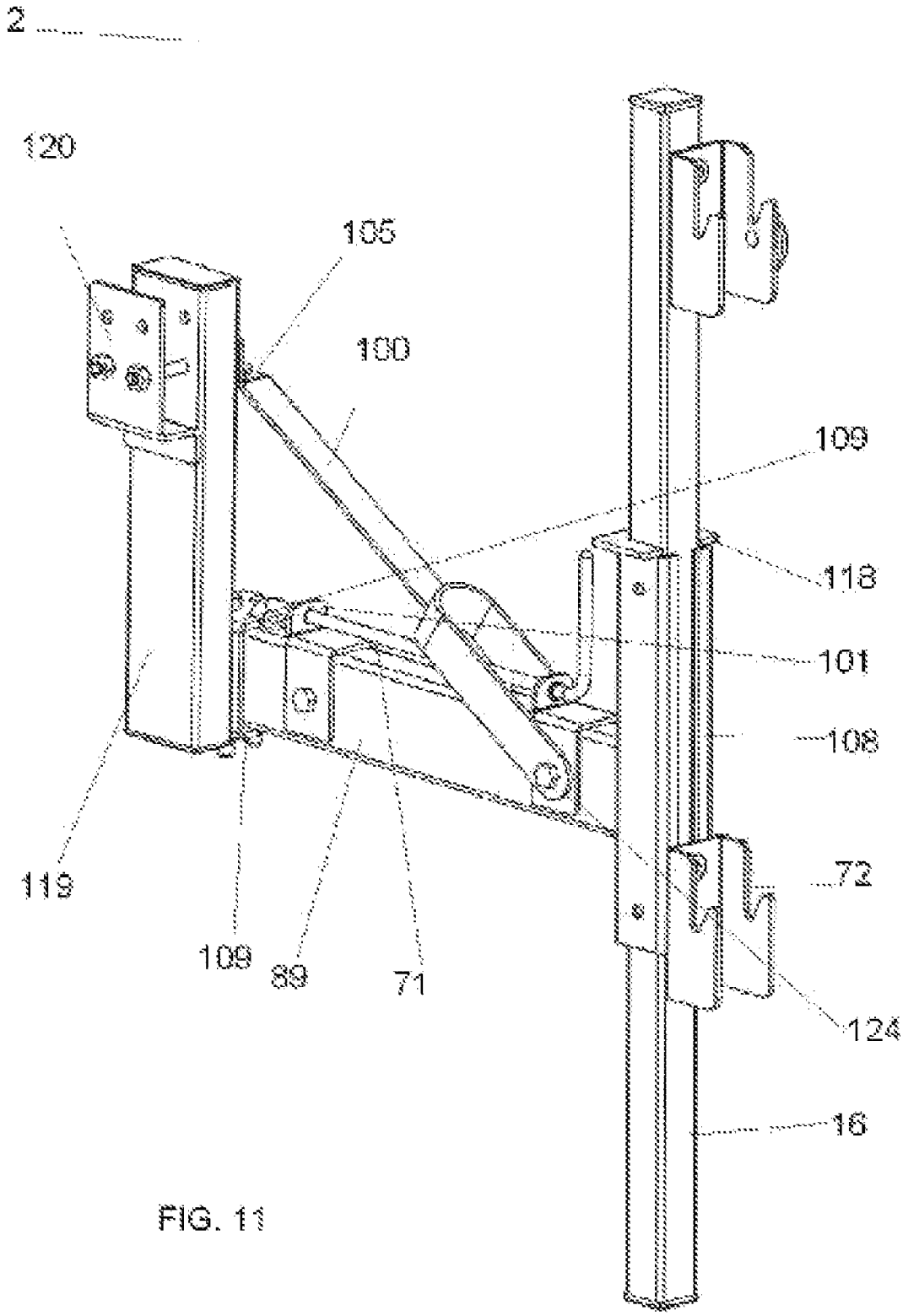
FIG. 11 is a detailed perspective view of a bed/gurney mount.
Figure 12:
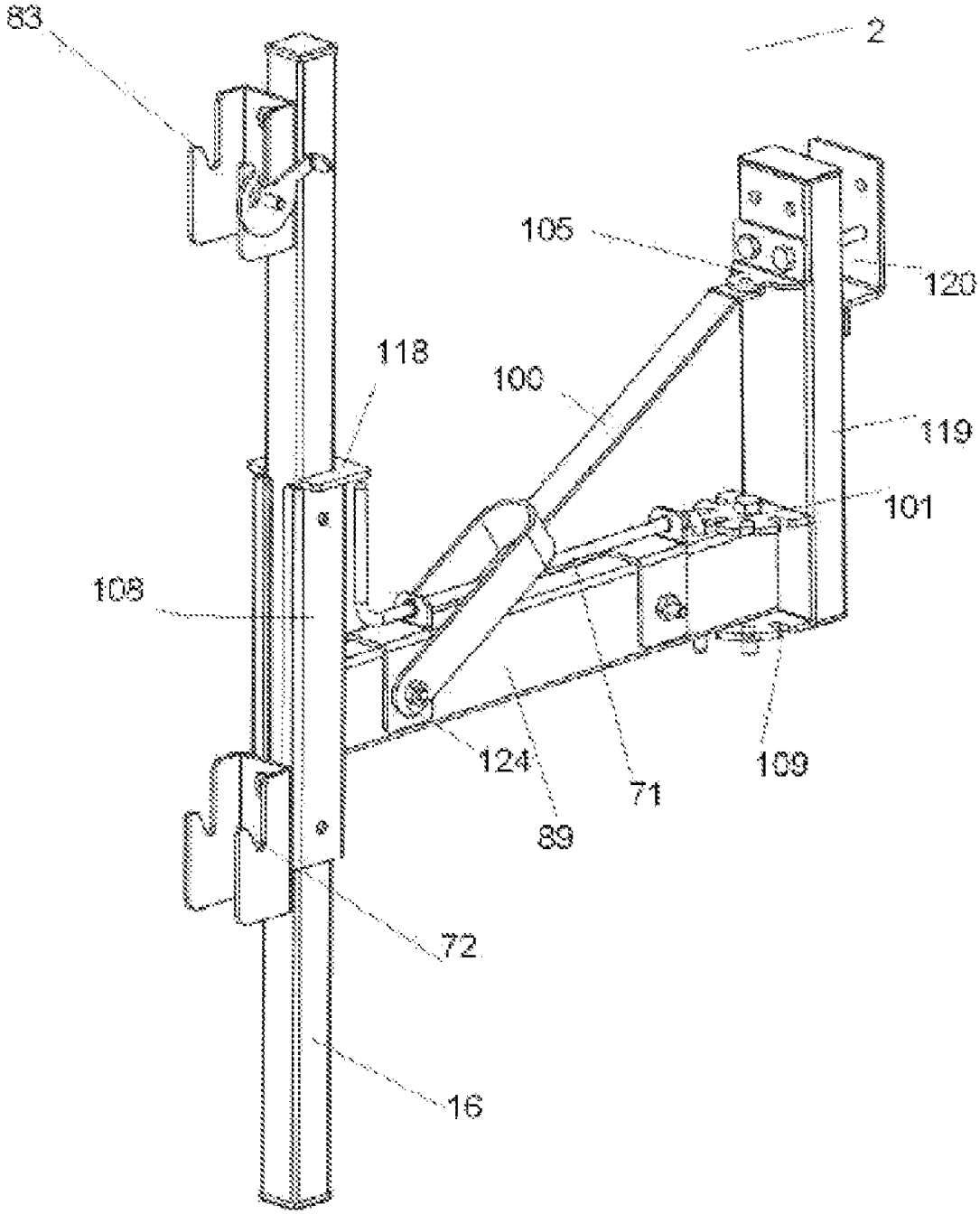
FIG. 12 is an alternative detailed perspective view of a bed/gurney mount.

Referring now to FIGS. 11 and 12 are an alternative embodiment of the bed/gurney attachment (2). FIG. 11 shows the attachment in a straight configuration and FIG. 12 shows the attachment in a pivoted arrangement. In this embodiment, the upper and lower connector troughs (83 and 72) are similarly located to support the pins of the IV pole (31 and 33 of FIG. 2). At least one of the troughs (83, 72) is engaged to an upper bar (16). The attachment also comprises an arm (89) extending between the upper bar (16) and a bracket bar (119). Engaged to the bracket bar (119) is a bracket (120) sized to fit over a portion of the frame of a bed (3 in FIG. 17).

In at least one embodiment, at least one of the connector troughs (83 and 72) is engaged to slidable member (108) capable of restrainably sliding up and down the upper bar (116). The slidable connection between the slidable member (108) and the upper bar (116) allows for the attachment (2) to be adjustably sized and positioned with beds of varying heights and sizes. In at least one embodiment, the slidable member (108) is a sleeve disposed about the upper bar (16). One or more sleeve stops (118) positioned above and/or beneath the slidable member (108) prevents the slidable member (108) from elevating or descending excessively. Embodiments contemplated by this invention also include attachments in which the connector troughs (83 and 72) are fixedly (not slidably) engaged to the upper bar (16). In addition, the slidable member (118) can be securedly fixed in place relative to the major vertical bar (81).

A diagonally directed brace (100) provides additional load bearing support to the attachment (2). The diagonal brace is pivotably engaged to the bracket bar (119) by at the first junction (105). The brace (100) is also engaged at one or more second junctions (124) to the arm (89). As depicted in FIG. 11, in at least one embodiment the brace has a Y shaped lower end where the two forks of the Y are engaged at second brace junctions (124) located on either side of the arm (89).

A releasing rod (71) is engaged to the arm (89). When in a locking position, the releasing rod prevents the arm (89) from pivoting relative to the bracket bar (119) and when in a released position. The releasing (71) rod allows the arm to pivot relative to the bracket bar (119). The releasing rod (71) works in conjunction with the slotted mount (109). As can best be seen in FIG. 12, the slotted mount (109) contains one or more slots into which the releasing rod can alternatively be inserted or withdrawn. When inserted the arm (89) is incapable of pivoting, when withdrawn, the arm (89) is released and capable of pivoting. Although FIG. 12 depicts an embodiment in which the slotted mount (109) has five slots allowing for five pivoting positions, more or fewer slots which would allow for a respectively equal, more, or fewer pivoting positions are contemplated by this invention. In at least one embodiment, the releasing rod (71) is engaged to the arm (89) by one or more arm loops (101). The various pivoting positions allow the IV pole (20 in FIG. 17) to be positioned in a number of positions relative to the bed (3 in FIG. 17).

Referring now to FIGS. 9A- 9D are shown at least one alternative embodiment of the wheelchair attachment (60) illustrated in FIG. 6 that is also designed to work in conjunction with the entire IV pole (20) seen in FIG. 2. At least one embodiment features an anti-tipping wheel assembly (4). This anti-tipping wheel assembly (4) is a safety precaution to prevent the wheelchair (11 in FIG. 1) from becoming tipped over if the patient exits the wheelchair and the wheelchair lacks a sufficient counterweight against the weight of the IV pole (20). The anti-tipping wheel assembly (4) remains in contact with the ground whether the IV pole wheels (24) are retracted off the ground or are in contact with the ground.

Figure 9A:
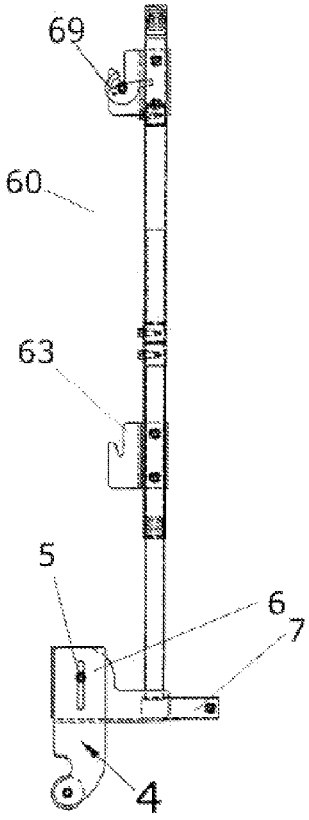
FIG. 9A is a detailed lateral side view of a wheelchair mount.
Figure 9D:
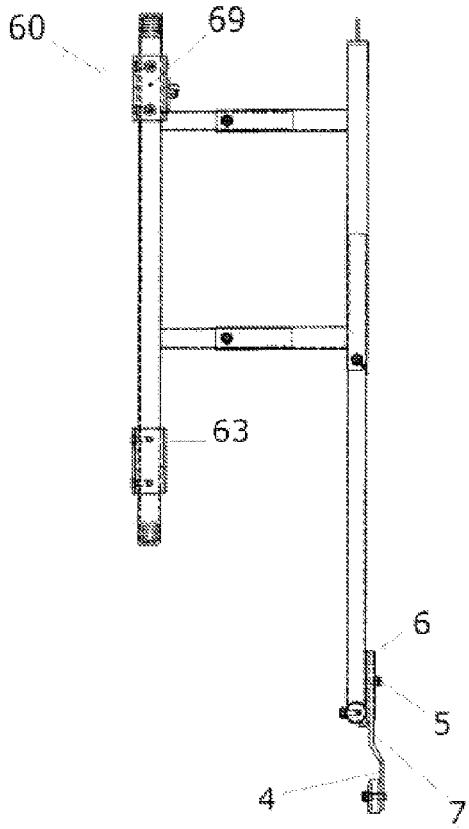
FIG. 9D is a detailed lateral front view of a wheelchair mount.
Figure 9B:
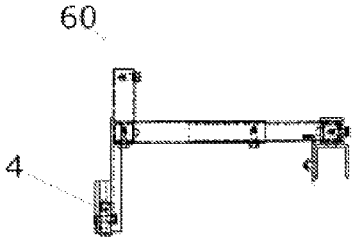
FIG. 9B is a detailed lateral top view of a wheelchair mount.
Figure 9C:
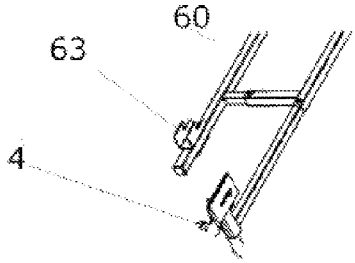
FIG. 9C is a detailed lateral isometric view of the bottom of a wheelchair mount.

As shown by comparing FIGS. 9A and 9B, the anti-tipping wheel assembly (4) is movable and can have its height desirably adjusted and then secured in place by a securement member (5). The securement member (5) can be a screw, pin, or similar fastening member. One embodiment of the height adjusted anti-tipping wheel assembly (4) involves a wheel height adjuster to be restrainably elevated or lowered through a slot (6) until a desired height is reached, and then is capable of being locked into position. In at least one embodiment, the anti-tipping wheel assembly's (4) operation is facilitated by a mounting member (7) which is capable of attachment to the lower portion of a wheelchair (11 in FIG. 1). In at least one embodiment, the mounting member is a hollow tube capable of fitting snugly over, or fitting over, and then being tightly clamped to, a bar that commonly extends out from the back of the bottom of a wheelchair (11) (such as 8 in FIG. 1).

Figure 10A:
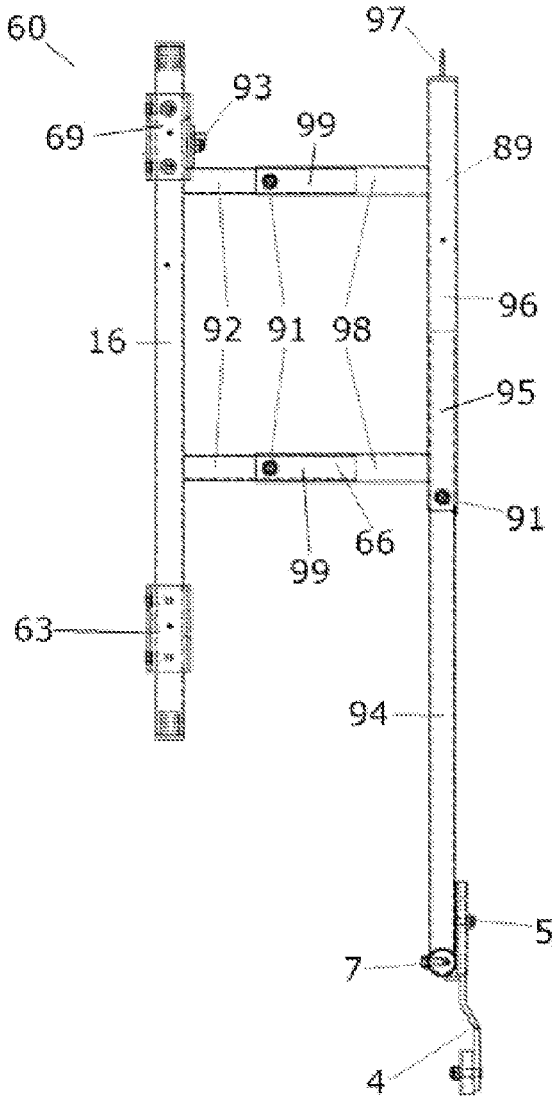
FIG. 10A is an alternative frontal view of a wheelchair mount.
Figure 10B:
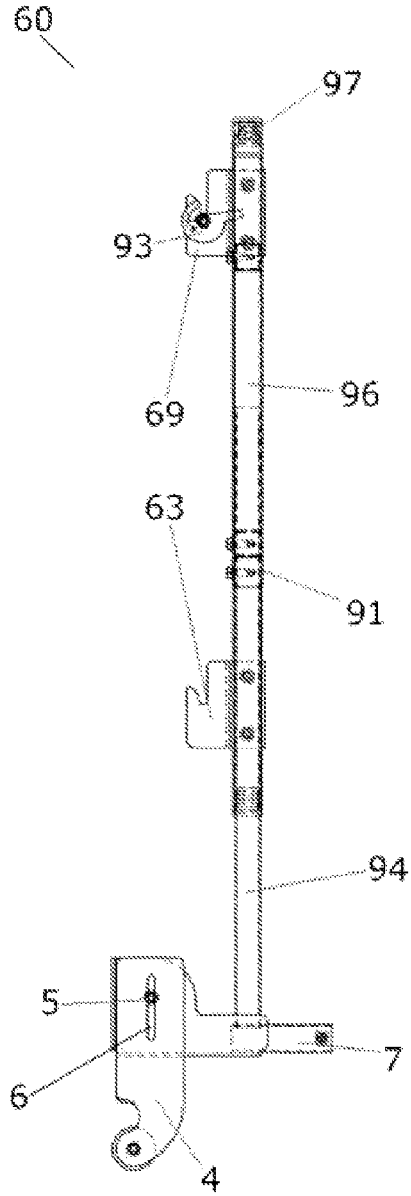
FIG. 10B is an alternative detailed side view of a wheelchair mount.

Referring now to FIGS. 10A and 10B there is shown at least one embodiment of the invention featuring a wheelchair attachment (60) with an adjustable height and an adjustable width. Such an adjustable attachment allows for positioning an attached IV pole (20 in FIG. 1) anywhere adjacent to the wheelchair (11 in FIG. 1) including anywhere within the recess (10 in FIG. 1) behind the seatback and between the handles (12 in FIG. 1) or to the left side, right side, rear left, rear right, or anywhere near the wheelchair (11 in FIG. 1). The adjustable wheelchair attachment (60) can be engaged to the wheelchair by a mounting member (7) engaged to a bar (8 in FIG. 1) extending out of the back bottom of the wheelchair and/or any other mechanism contemplated by this invention. The wheelchair attachment comprises at least three portions, a height adjustable arm (89), a side length adjustable middle bar (66) and an upper bar (16) supporting pin troughs (69, 63) which functions the same as the upper bar (16) in FIG. 6. Unlike the embodiment in FIG. 6, the adjustable wheelchair attachment (60) allows the same IV pole to be used with any kind of wheelchair commonly used in the medical field. The arm (89) provides at least one secure engagement with the wheelchair at a position where an adequately located bar (such as 8 in FIG. 1) is located. The height and side adjustability allows the upper bar (16) to be positioned anywhere relative to the adequately located bar (such as 8 in FIG. 1) which is conducive for positioning the IV pole. The selected position of the upper bar (16) determines where the IV pole (20 in FIG. 2) is positioned relative to the wheelchair (11 in FIG. 1).

In at least one embodiment depicted in FIGS. 10A and 10B, the wheelchair attachment (60) comprises one or more arms (89) having an adjustable height. In at least one embodiment the adjustable height is achieved through the interaction of a lower portion (94) of the arm (89), which is slidably engaged to an upper portion (96) of the arm (89). In one embodiment the lower and higher portions (94, 96) are bridged by a central portion (95) of the arm (89). Although FIG. 10A illustrates the central portion (95) as a hollow tube which fits over the lower portion (94), contemplated embodiments include a hollow lower portion fitting over a narrower central portion. A locking mechanism (91) such as a releasable screw alternatively tightens or loosens the lower portion (91) respectively locking in place or freeing for adjustment the arm's (89) height. Alternatively positioning apertures may be disposed through a portion of the upper portion (96), central portion (95), or lower portion (94) for alignment and receipt of a positioning pin to adjust the height side length of the attachment (60). At least one embodiment of this concept is the one or more pins extending through apertures analogous to the cooperating holes described in U.S. Pat. No. 2,691,411 which is hereby incorporated by reference in its entirety.

In at least one embodiment the wheelchair attachment (60) comprises at least one middle bar (66) having an adjustable length. Although FIG. 10A illustrates one purely height adjustable bar (89) engaged to two purely side adjustable middle bars (66), embodiments in which more or fewer of either kind of bar or bars which perform some combination of both height and side adjustment (such as diagonal bars) are contemplated by this invention. In one embodiment, the side adjustment is achieved in a manner similar to the height adjustment of the arm (89). A fore side length (98) is movably engaged to an aft side length (92) by a hollow central portion (99) snugly and movably disposed about the aft side length (92). Each of the central portions (99) has one or more locking mechanisms (91) (such as screws that can releasably press tightly against the length within the central portion) to release or seal the selected side length or height. By varying the side length and height of the wheelchair attachment (60), a wheelchair of almost any dimensions can be suitably mated to the IV pole of FIG. 2.

In at least one embodiment one or more of the troughs (63, 69) also feature one or more safety latches (93) to secure the pins (31 and 33 of FIG. 2) to the wheelchair attachment (60). These latches (93) assure that should any other portion of the patient transport device fail (for example if a trough, pin, upper bar, or IV pole shaft cracks bends or breaks), the IV poles will not detach from the troughs and will remain firmly in contact with the attachment (60). Depicted in FIG. 10B is one embodiment of a safety latch (93) which comprises a rotatable disk with a solid portion and a path portion. The disk is biased (by gravitational design or a biasing device such as a spring) such that the solid portion aligns with the trough (63, 69). Upon the application of a rotational force (such as a user rotating the safety latch) the path portion aligns with the trough (63, 69). When so aligned, the pins (31, 33 of FIG. 2) can move out of the trough (63, 69). When not so aligned the solid portion blocks the movement of the pins (31, 33 of FIG. 2) out of the troughs (63, 69). The safety latch (93) can be designed to allow free entry of the pins (31, 33 of FIG. 2) and releasably restrain their exit, or block both the entry and exit of the pins (31, 33 of FIG. 2) without proper rotation of the safety latch.

Figure 13:
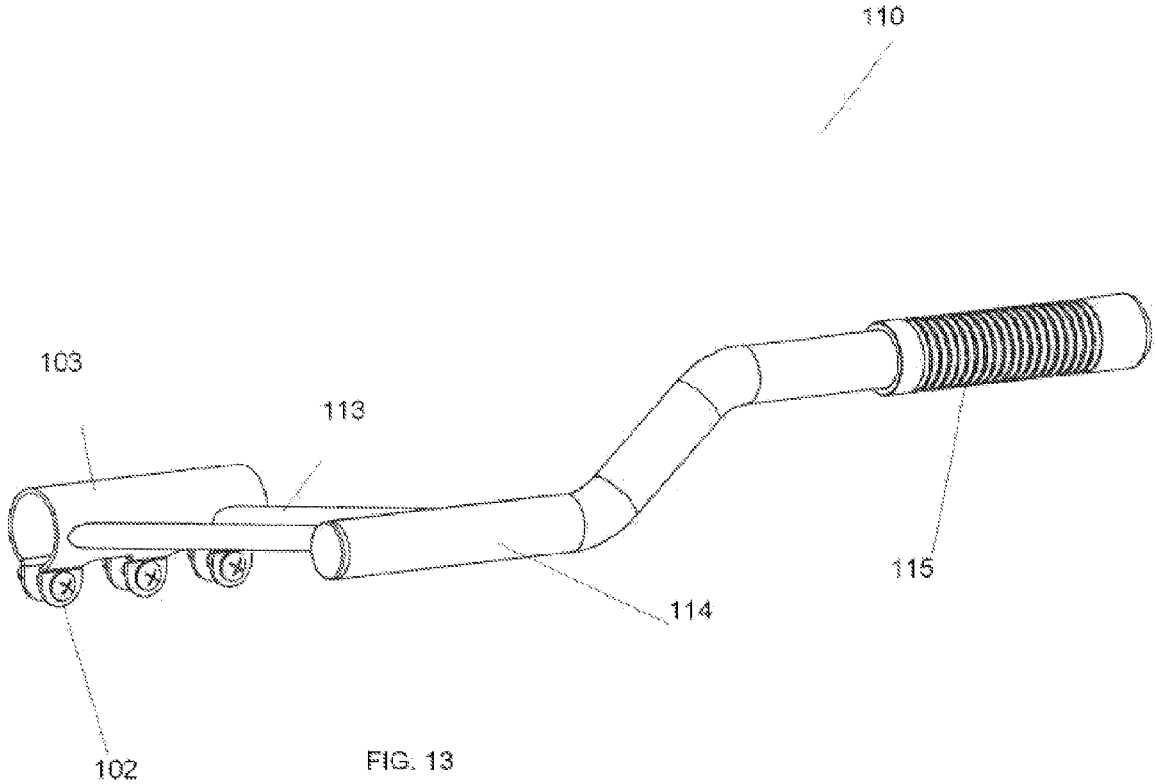
FIG. 13 is a detailed perspective view of a wheelchair grip adapted to work with the wheelchair mount.

In at least one embodiment, the wheelchair attachment (60) has a tab (97) adapted to be engaged to the wheelchair by a handle extension such as that illustrated in FIG. 13. This tab can comprise screw threads, tapering, or other fitted designed to assure proper engagement of a handle extension to the tab (97). Referring now to FIG. 13 there is shown a handle extension (110). The handle extension can be designed for engagement to an attachment tab (97 of FIG. 10A) or to any other portion of a patient holding apparatus (such as a wheelchair, gurney, bed or the like), IV pole or both.

In at least one embodiment, a gripping member (113) may be engaged by the releasable tightening through the use of a sealing screw (102) as desired to a portion of a wheelchair or other patient holding apparatus. In at least one embodiment, the handle extension (110) engages to the handle (12 of FIG. 1) of a wheelchair. The handle extension (110) comprises a sealing clamp (103) capable of fitting a desired component of a wheelchair or other patient holding apparatus.

In at least one embodiment the handle extension (110) positions a handle (115) to the side of, and/or obliquely from, a patient support apparatus such as a bed or wheelchair. This positioning of the handle (115) may provide a benefit when one or more IV poles (20 in FIG. 2) are utilized which are bulky and offset positioning may enable one or more IV pole(s) to be positioned close to the patient. Offset positioning may also allow for pushing the wheelchair when it is otherwise difficult to grip a handhold or holding purchase at a central or balanced position on the support apparatus. Engaging the handle extension to project away from the patient support apparatus allows the IV pole to be properly positioned while allowing the transporting medical personnel to locate themselves in any proximal location they find to be practical. The handle (115) is connected to the sealing clamp (103) by one or more supporting members (113). In at least one embodiment position of the handle (115) is further modified by a bending member (114) that allows the handle to be positioned at an ergonomic or convenient angle. The handle extension (110) can angle the handle (115) to be positioned to the side of an IV pole having wings as depicted in FIG. 14A.

Figure 14A:
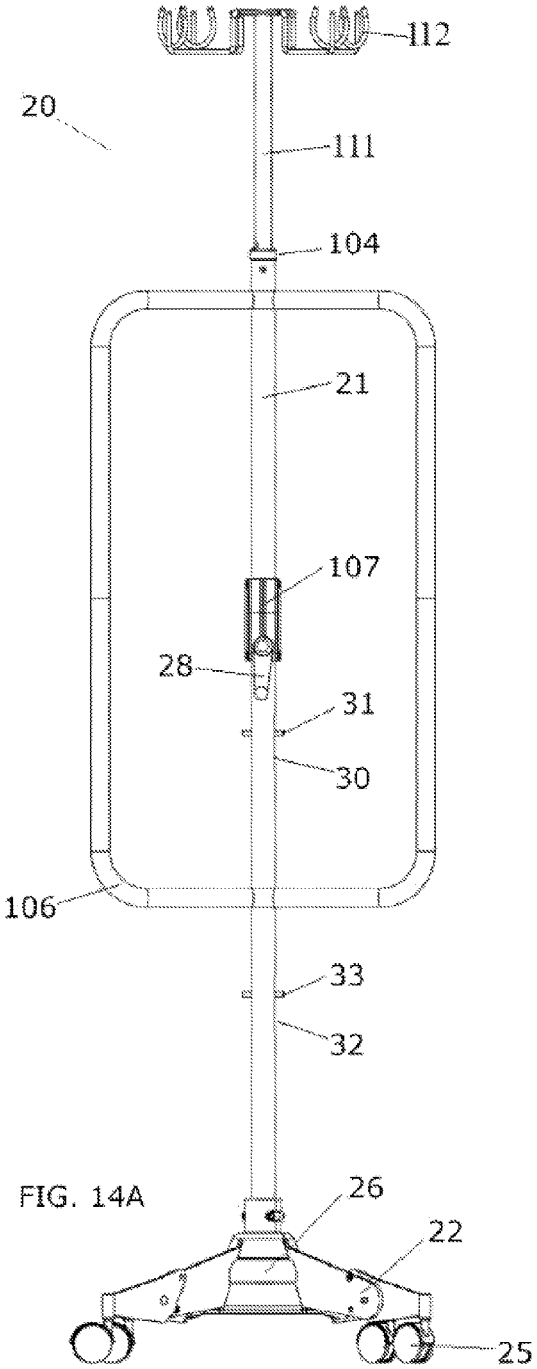
FIG. 14A is an alternative frontal view of a cranking IV pole.
Figure 14B:
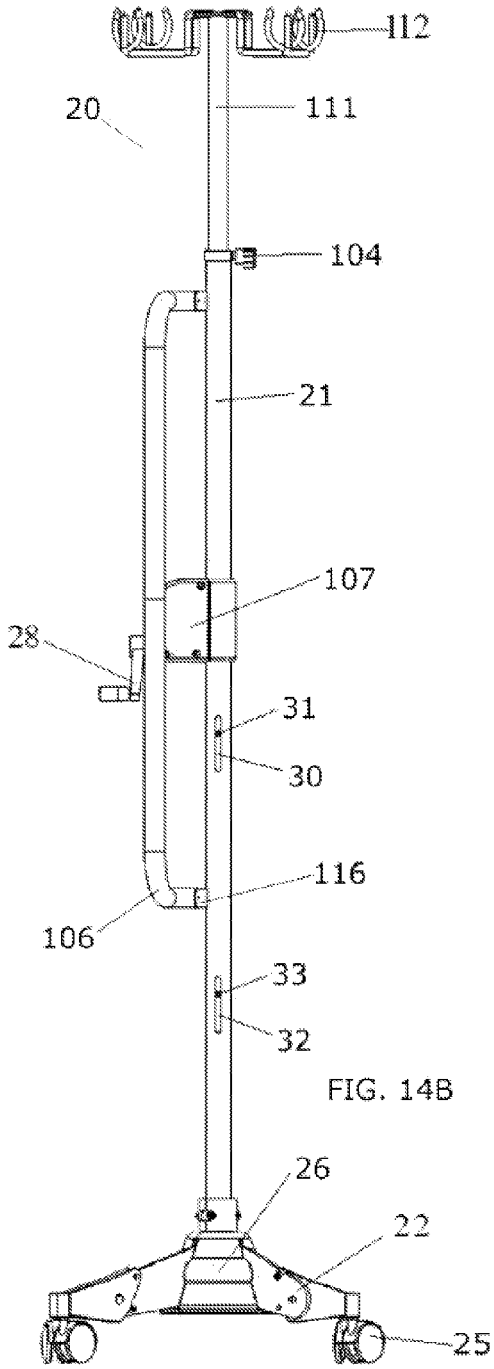
FIG. 14B is an alternative side view of a cranking IV pole.

Referring now to FIGS. 14A and 14B there is shown an embodiment of an IV pole (20) having wings (106). The wings (106) allow more pumps, bags, and other medical equipment to be attached to the IV pole (20). The wings can be angled forward to draw the equipment away from the back of the patient when sitting in a wheelchair (11 in FIG. 1). When so angled, if an axis were extended between the ends of the two wheelchair handles (12 in FIG. 1), at least one of the wings would extend at an oblique angle relative to such an axis. This angling allows the IV pole (20) to be positioned close to the patient and even within the space between a wheelchair's handles (12 in FIG. 1) while supporting more pumps, bags, and other medical equipment close to the patient.

In at least one embodiment the wheel casters (25) are 3 inch casters. In at least one embodiment, the front legs (23) of the base (22) are longer than the rear legs (23) of the base (22). In at least one embodiment there are 4 legs, 2 long and 2 short. In at least one embodiment, one or more longer legs (23) are 2 inches longer. Longer legs (23) can be used to provide compensating balance for the angled wings (106). Because the angled wings (106) shift the poles center of gravity away from the center of the shaft (21), any risk of the wings causing the pole to tip over can be averted by increasing the lengths of legs (23) which extend in the same direction that wings (106) extend. These longer legs however are capable of retracting according to the description for FIGS. 4 and 5 so are capable of fitting within the recess between the handles (12 of FIG. 1) of the wheelchair (11 of FIG. 1).

Figure 15A:
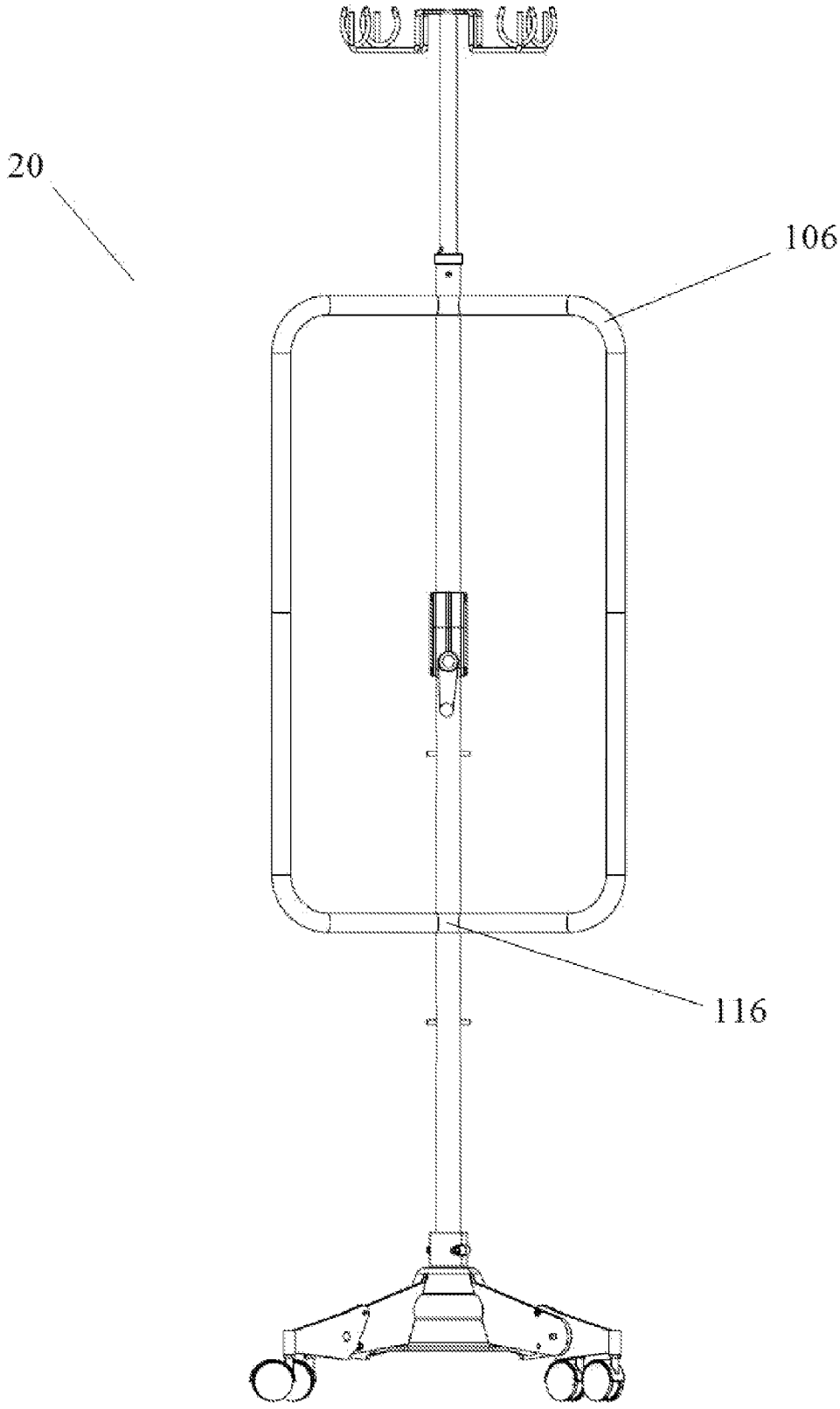
FIG. 15A is an alternative perspective view of a cranking IV pole.

A twisting knob (104) allows the release and securing of the upper part (111) of the IV pole so that it can be extended higher or be lowered. Additional hooks (112) can be positioned along the shaft (21) or at the top of the shaft (21) to hold additional bags or other medical equipment. In addition as illustrated in FIG. 15A, the angled wings (106) can be releasably engaged to the IV pole (20) by pole hooks (116).

Figure 15B:
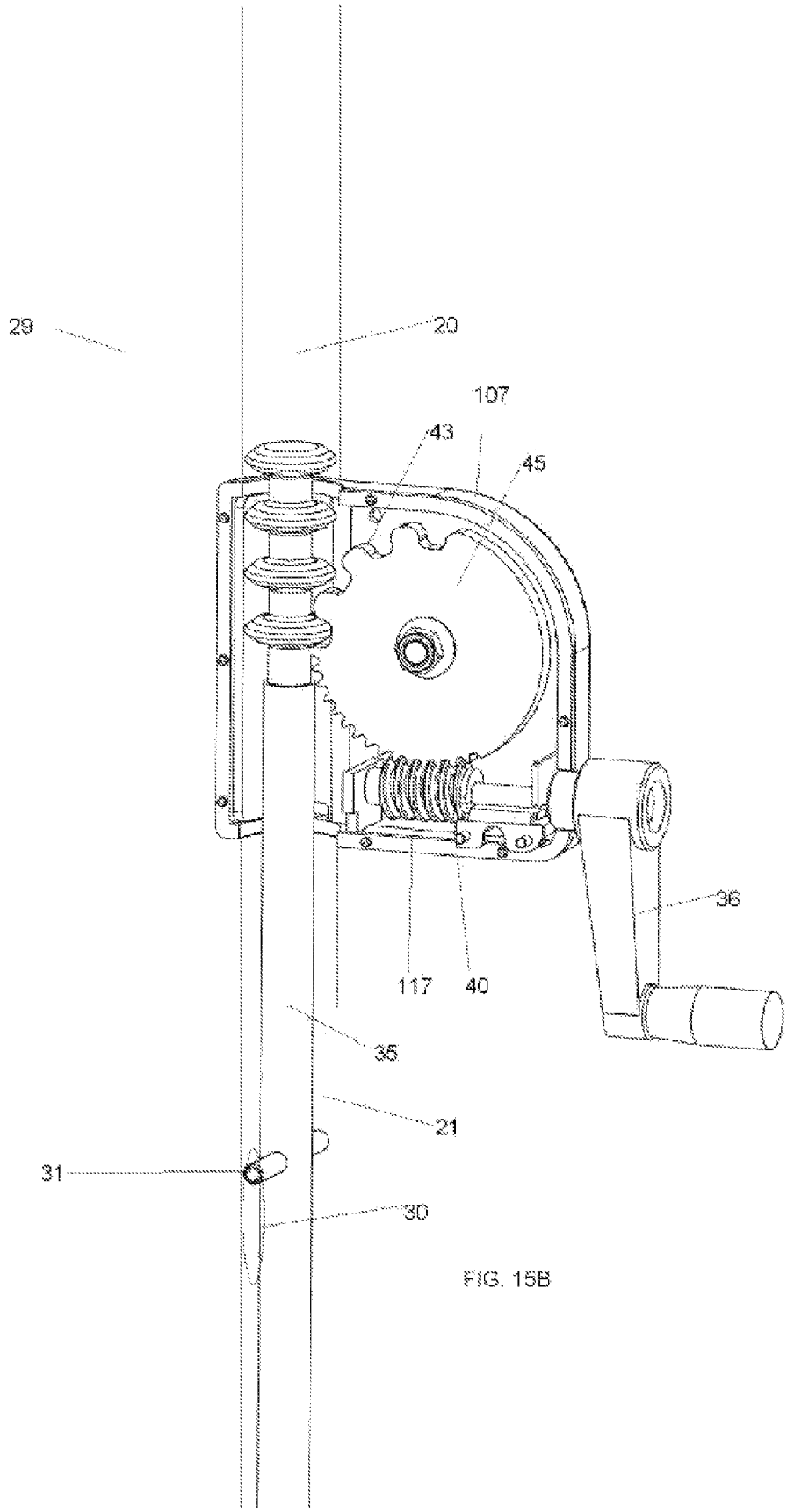
FIG. 15B is an alternative detailed view of the cranking mechanism.

Referring now to FIG. 15B, there is shown an alternative embodiment of the upper gears (29) of the IV pole (20). In this embodiment, the gears (29) include a major gear (45) which is interlockedly connected to a worm gear (117) by small grooves (40) and is interlockedly connected to the large gear (45) of the inner rod (35) by large grooves (43). The worm gear (117) is rotated by a crank handle (36). It will be understood that this invention contemplates variations of the upper gears (29) illustrated in FIGS. 1, 15B, and 3 in which the various groove sizes are equal, of opposite proportional sizes shown in the drawings, and of any combination of large, small and equal sized grooves and are not strictly limited to those proportions shown in FIGS. 1, 3, and 15B. When the crank handle (36) of FIG. 15B is rotated, the inner rod (35) alternatively causes the pin (31) to elevate or descend within the slot (30) defined by the wall of the hollow portion of the shaft (21) of the IV pole (20). The upper gears (29) can be concealed within a cover plastic cover (107).

Figure 21:
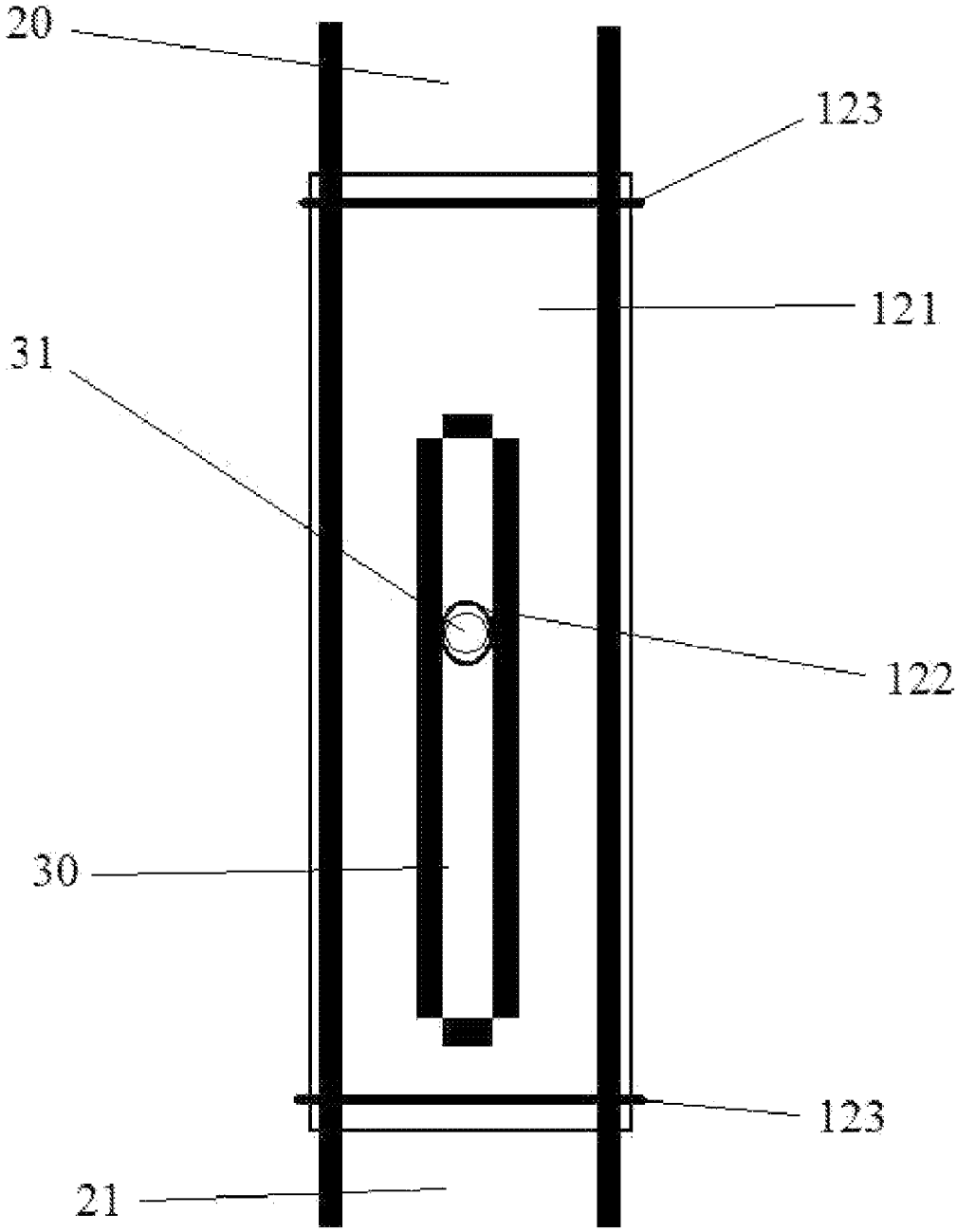
FIG. 21 is an alternative detailed view of a reinforcing cover over a pin slot of an IV pole.

Referring now to FIG. 21 is an embodiment of the invention in which a reinforcing cover (121) is positioned over at least one of the slots (30). The reinforcing cover (121) has a pin hole (122) which is just large enough for a pin (31) to fit through. When the pins (31) are being elevated or descended, the pins pull or push the reinforcing cover (121) up or down the IV pole (20). Thus the reinforcing cover (121) assures that no possibly spilled fluids or other materials enter the hollow portion of the IV pole (20). In at least one embodiment the reinforcing cover (121) comprises two or more pieces which fit around the IV pole (20). These two or more pieces are held together by one or more elastic rings (123) wrapping around the IV pole's circumference. In at least one embodiment, the two or more pieces are semi-hemispheres. In at least one embodiment, the reinforcing cover (121) is at least partially made of a transparent material. In at least one embodiment the reinforcing cover (121) is easily removable and can be sanitized independently from the IV pole as a whole. In at least one embodiment the IV pole comprises two or more identically dimensioned reinforcing covers (121) that are interchangeable.

This completes the description of the preferred and alternate embodiments of the invention. The above disclosure is intended to be illustrative and not exhaustive. This description will suggest many variations and alternatives to one of ordinary skill in this art. The various elements shown in the individual figures and described above may be combined, substituted, or modified for combination as desired. All these alternatives and variations are intended to be included within the scope of the claims where the term "comprising" means "including, but not limited to".

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claims below.

The invention claimed is:

1. A patient transporting device comprising: a patient holding apparatus; an IV pole comprising, a top, a bottom, a shaft and a wheeled base having wheels engaged to a portion of the shaft; and an attachment mount capable of releasably engaging both the IV pole and the patient holding apparatus; wherein the wheels are vertically longitudinally adjustable relative to the shaft for releasable engagement of the patient holding apparatus to the attachment mount, the IV pole further comprising one or more pins engaged to the wheeled base, the attachment mount further comprising one or more troughs constructed and arranged for receipt of the one or more pins, the IV pole further comprising a raising/lowering mechanism engaged to the one or more pins, wherein manipulation of the raising/lowering mechanism enables the receipt of the one or more pins by the one or more troughs pulling the wheeled base off of the ground.

2. The patient transporting device of claim 1 wherein the patient holding apparatus is selected from one of the group consisting of: a wheelchair and a wheeled bed.

3. The patient transporting device of claim 2 the patient holding apparatus being a wheelchair, the attachment mount further comprising a hollow portion of a tube the attachment mount becomes engaged to the wheelchair by the hollow tube which is constructed and arranged to fit over a bar extending out from the bottom of the back of the wheelchair.

4. The patient transporting device of claim 1, the attachment mount is laterally pivotably engaged to the patient holding apparatus, the attachment mount constructed and arranged to permit the IV pole to pivot around the patient holding apparatus.

5. The patient transporting device of claim 4, wherein the attachment mount further comprises a plurality of positioning slots, the positioning slots constructed and arranged to position the IV pole at fixed angles relative to the patient holding apparatus, at least one positioning slot constructed and arranged to positioning the shaft at a distance from the patient holding apparatus which is less than the distance between the wheels and the shaft when the wheels are supporting the IV pole on the ground.

6. The patient transporting device of claim 4 the patient holding apparatus being wheeled bed, said attachment mount further comprising a mount wheel positioned at a bottom most portion of the attachment.

7. The patient transporting device of claim 1, further comprising a pin spring, the pin spring engaged to the attachment mount and providing a pulling tension against the attachment mount in the direction of the patient holding apparatus, the pulling tension pulls the IV pole closer to the patient holding apparatus.

8. The patient transporting device of claim 1, the wheeled base comprising at least one leg having a length, at a first position along the length the leg is vertically pivotably engaged to the shaft, at a second position along the length a wheel is engaged to the leg.

9. The patient transporting device of claim 1, the patient holding apparatus being a wheelchair, the patient transporting device further comprising a handle engaged to the attachment mount, the handle extending at an oblique angle relative to the wheelchair.

10. The patient transporting device of claim 1 in which the attachment mount further comprises a crank, the crank being constructed and arranged to elevate and lower the pins relative to the troughs.

11. The patient transporting device of claim 10, the IV pole further comprising a hollow portion and a rod extending from the crank to the wheeled base, the crank capable of raising and lowering the wheeled base up off of a surface.

12. The patient transporting device of claim 11 further comprising a hooking pin engaged to the attachment mount constructed and arranged to permit the IV pole to pivot around at least a portion of the wheeled bed.

13. The patient transporting device of claim 1, wherein the IV pole is constructed and arranged to support bags or pumps when the wheels are adjusted into an elevated position.

14. The patient transporting device of claim 1, in which the attachment mount is pivotably engaged to the patient holding apparatus.

* * * * *